US010080470B2

(12) United States Patent
Krengel et al.

(10) Patent No.: US 10,080,470 B2
(45) Date of Patent: Sep. 25, 2018

(54) PAPER-TOWEL APPARATUS FOR REUSING NON-STRUCTURED PAPERLESS PAPER-TOWELS

(75) Inventors: Steven Krengel, Chicago, IL (US); Hyung Seok Lee, Chicago, IL (US); Marianne Grisdale, Chicago, IL (US); James Dangora, Chicago, IL (US)

(73) Assignee: Kitchens.com, Chicago, IL (US)

( * ) Notice: Subject to any disclaimer, the term of this patent is extended or adjusted under 35 U.S.C. 154(b) by 0 days.

(21) Appl. No.: 12/885,942

(22) Filed: Sep. 20, 2010

(65) Prior Publication Data

US 2011/0095043 A1 Apr. 28, 2011

Related U.S. Application Data

(60) Provisional application No. 61/243,695, filed on Sep. 18, 2009, provisional application No. 61/243,705, filed on Sep. 18, 2009.

(51) Int. Cl.
*G07F 11/00* (2006.01)
*A47K 10/46* (2006.01)

(52) U.S. Cl.
CPC ..... *A47K 10/46* (2013.01)

(58) Field of Classification Search
CPC ..... A47K 10/46
USPC ..... 221/102, 33, 34; 242/578, 598.3, 598.6; 132/277; 225/103
See application file for complete search history.

(56) References Cited

U.S. PATENT DOCUMENTS

| | | | | |
|---|---|---|---|---|
| 1,520,160 | A | 12/1924 | Van Der Wyk | |
| 1,693,477 | A | 11/1928 | Collins | |
| 1,724,128 | A | 8/1929 | Collins | |
| 2,224,802 | A * | 12/1940 | Spless | B65H 3/0825 271/103 |
| 2,227,969 | A * | 1/1941 | Haushalter | B29C 33/0055 264/138 |
| 2,363,149 | A | 11/1944 | Jacques | |
| 2,971,266 | A | 2/1961 | Silva | |
| 3,086,724 | A | 4/1963 | Powell | |
| 3,350,736 | A | 11/1967 | Frazelle et al. | |
| 3,459,329 | A * | 8/1969 | Mochizuki | B65D 83/0805 221/34 |
| 3,799,466 | A | 3/1974 | Adams | |

(Continued)

OTHER PUBLICATIONS

U.S. Non-Final Office Action for U.S. Appl. No. 12/886,041 dated May 24, 2012, 15 pages.

(Continued)

*Primary Examiner* — Rakesh Kumar
(74) *Attorney, Agent, or Firm* — Fish & Richardson P.C.

(57) ABSTRACT

A reusable towel dispenser includes a reusable towel holding compartment including multiple reusable towels stored in a non-structured manner. The dispenser also includes a reusable towel output of the reusable towel holding compartment, the reusable towel output being configured to enable a reusable towel of a group of non-structured reusable towels to be accessed and pulled, from the reusable towel holding compartment, out of the reusable towel dispenser. The dispenser further includes a reusable towel input of the reusable towel holding compartment, the reusable towel input being configured to allow a group of non-structured reusable towels to be concurrently loaded in the reusable towel holding compartment.

9 Claims, 18 Drawing Sheets

(56) References Cited

U.S. PATENT DOCUMENTS 3,897,122 A 7/1975 McEvers
4,084,080 A * 4/1978 McMahan ..... A45D 44/00 122/459
4,087,080 A * 5/1978 Steinegger et al. ..... 266/88
4,089,481 A * 5/1978 Ciuci ..... 242/564.4
4,429,638 A 2/1984 Licari
4,491,242 A * 1/1985 Trinidad ..... A47K 10/426 211/50
4,573,608 A 3/1986 Hansen
4,653,742 A * 3/1987 Sasaki ..... B65H 3/063 271/114
4,709,914 A * 12/1987 Taylor ..... B65H 7/00 209/534
4,768,770 A * 9/1988 Pessina ..... B65H 3/0808 270/52.14
4,924,562 A 5/1990 Pogharian
5,042,687 A * 8/1991 McKinley ..... 221/311
5,083,661 A 1/1992 Burwell
5,100,121 A * 3/1992 Takei ..... B65H 3/34 271/104
5,131,112 A 7/1992 Cervini
5,181,707 A * 1/1993 Takei ..... B65H 3/0833 271/103
5,256,022 A * 10/1993 Neudecker ..... G03B 42/045 271/107
5,328,165 A * 7/1994 Martin ..... B65H 3/128 271/98
5,350,166 A * 9/1994 Shimizu ..... B65H 3/0833 271/106
5,386,910 A * 2/1995 Liss ..... 206/554
5,439,521 A * 8/1995 Rao ..... A47K 10/3827 118/415
5,451,108 A * 9/1995 Anderson ..... 383/38
5,511,691 A * 4/1996 West, Jr. ..... 221/311
5,736,714 A * 4/1998 Bechtold, Jr. ..... 219/521
5,754,999 A 5/1998 Helmsderfer
5,876,031 A * 3/1999 Ohkoda ..... B65H 3/0833 271/107
5,921,540 A * 7/1999 Acquaviva ..... B65H 3/128 271/104
5,947,277 A * 9/1999 Sherman ..... 206/216
5,950,960 A * 9/1999 Marino ..... A47K 10/32 242/594.1
6,015,145 A * 1/2000 Hartel ..... B65H 3/0875 270/52.2
6,046,436 A 4/2000 Hunts
D431,735 S * 10/2000 Sullivan ..... D6/515
6,349,849 B1 * 2/2002 Pehr ..... A47K 10/421 221/33
6,402,085 B1 * 6/2002 Smith ..... A47K 10/40 242/578
6,443,327 B1 * 9/2002 Chen ..... A47F 1/08 206/315.9
6,503,326 B1 * 1/2003 Mikelionis ..... A47K 10/32 118/419
6,536,707 B2 * 3/2003 Adelakun ..... A47K 10/38 242/160.1
6,688,549 B1 * 2/2004 Shen ..... B65H 35/0026 242/588
6,776,097 B2 * 8/2004 Takeda ..... B65H 1/14 101/389.1
6,886,714 B2 * 5/2005 Kruchoski ..... B65D 83/0805 221/302
7,044,329 B2 * 5/2006 Lum et al. ..... 221/45
7,100,506 B2 * 9/2006 Takeda ..... B65H 1/14 101/389.1
7,147,129 B1 12/2006 Menefield
7,363,753 B2 * 4/2008 Gates ..... B65B 43/18 53/284.7
7,380,689 B2 * 6/2008 Parietti ..... A47K 10/42 221/282
7,562,868 B2 * 7/2009 Giese ..... B65H 3/08 271/104
7,694,957 B2 * 4/2010 Nukada ..... B65H 3/60 271/146
7,717,293 B2 * 5/2010 Bellafatto ..... A47F 13/085 221/312 C
7,726,513 B2 6/2010 Schlaupitz et al.
7,870,997 B2 * 1/2011 Eastman ..... G07D 11/0006 235/379
8,079,104 B2 12/2011 Presnell et al.
8,099,810 B2 1/2012 Presnell et al.
8,104,847 B2 * 1/2012 Colon ..... A47K 10/38 242/598.5
8,336,870 B2 * 12/2012 Kobayashi ..... B65H 1/14 271/10.01
2002/0079322 A1 * 6/2002 Wilkes ..... A47K 10/421 221/34
2002/0096596 A1 * 7/2002 Adelakun ..... A47K 10/38 242/570
2002/0162848 A1 * 11/2002 Na ..... A47K 10/38 221/63
2003/0015513 A1 * 1/2003 Ellis ..... 219/400
2003/0189059 A1 * 10/2003 May ..... A47K 10/421 221/34
2004/0065221 A1 * 4/2004 Takeda ..... B65H 1/14 101/477
2005/0224538 A1 10/2005 Stewart
2007/0029718 A1 * 2/2007 Giese ..... B65H 3/08 271/90
2008/0078857 A1 * 4/2008 Parietti ..... A47K 10/42 242/598.3
2008/0264965 A1 * 10/2008 Reinsel ..... A47K 10/426 221/44
2009/0114670 A1 * 5/2009 Bellafatto ..... A47F 13/085 221/92
2009/0255552 A1 10/2009 Hsu
2009/0289137 A1 * 11/2009 Fischer ..... A47K 10/3827 242/170
2011/0095043 A1 * 4/2011 Krengel ..... A47K 10/46 221/102
2013/0105505 A1 * 5/2013 Leeper ..... B65H 3/62 221/1
2013/0240556 A1 * 9/2013 Yamada ..... B65D 75/5894 221/63
2013/0284756 A1 * 10/2013 Springer ..... B65D 83/08 221/34

OTHER PUBLICATIONS

PCT International Search Report and Written Opinion issued in PCT International Application No. PCT/US2010/049459 dated Nov. 15, 2010.
U.S. Non-Final Office Action for U.S. Appl. No. 12/885,984 dated Oct. 2, 2012, 18 pages.
U.S. Final Office Action for U.S. Appl. No. 12/885,984 dated Jul. 15, 2013, 21 pages.
U.S. Final Office Action for U.S. Appl. No. 12/886,041 dated Mar. 14, 2013, 16 pages.

* cited by examiner

PAPER-TOWEL APPARATUS FOR REUSING NON-STRUCTURED PAPERLESS PAPER-TOWELS

CROSS-REFERENCE

This present application claims priority from U.S. Provisional Application No. 61/243,695 filed Sep. 18, 2009, which is titled "Paper-Towel Apparatus for Reusing Non-Structured Paperless Paper-Towels and from U.S. Provisional Application No. 61/243,705 filed Sep. 18, 2009, which is titled "Paper-Towel Apparatus for Reusing Non-Structured Paperless Paper-Towels," the entire contents of each of which are incorporated by reference.

TECHNICAL FIELD

This document relates to an apparatus configured to enable reuse of paperless paper-towels.

BACKGROUND

Disposable paper-towels are commonly found in households and commercial businesses. For example, a long flat paper sheet is stamped into numerous loosely connected tissue paper sections (or tissues) and wrapped around the circumference of a cardboard tube to form a traditional paper-towel roll. The tissues of a traditional paper-towel roll are structured in that they are organized as a circumferential wrapping which spirals around the cardboard tube. Each tissue can be unwrapped and detached from the next tissue by a slight physical force.

Also, tissue paper sections can be separated and structured in an enclosed container with a thin opening during manufacturing so as to enable removal of tissues one at a time. In particular, the tissues can be stacked in a box, one directly on top of another, such that removal of the final tissue pulls the next tissue to expose a flap of the tissue for ease of handling through the thin opening. In this configuration, the tissues are not connected after manufacture.

SUMMARY

In general, in some aspects, a dispenser includes a reusable towel holding compartment including multiple reusable towels stored in a non-structured manner. The dispenser also includes a reusable towel output of the reusable towel holding compartment, the reusable towel output being configured to enable a reusable towel of a group of non-structured reusable towels to be accessed and pulled, from the reusable towel holding compartment, out of the reusable towel dispenser. The dispenser further includes a reusable towel input of the reusable towel holding compartment, the reusable towel input being configured to allow a group of non-structured reusable towels to be concurrently loaded in the reusable towel holding compartment. In addition, the dispenser includes an outer circumferential casing of the reusable towel dispenser and an inner circumferential casing of the reusable towel dispenser. The reusable towel holding compartment is defined between the inner circumferential casing and the outer circumferential casing. The inner circumferential casing defines an inner hollow space which is open at either end of the reusable towel dispenser and which is configured to accommodate passage of a paper-towel holding rod configured to mount a paper-towel roll.

In other implementations, some aspects include a reusable towel dispenser including a reusable towel holding compartment including multiple reusable towels stored in a non-structured manner. The dispenser also includes a reusable towel output of the reusable towel holding compartment, the reusable towel output being configured to enable a reusable towel of a group of non-structured reusable towels to be accessed and pulled, from the reusable towel holding compartment, out of the reusable towel dispenser. The dispenser further includes a reusable towel input of the reusable towel holding compartment, the reusable towel input being configured to allow a group of non-structured reusable towels to be concurrently loaded in the reusable towel holding compartment.

This and other implementations can optionally include one or more of the following features, which also may optionally be in any combination. For example, the reusable towel input can be an opening created by movement of an outer circumferential case relative to the reusable towel dispenser. The movement of the outer circumferential case relative to the reusable towel dispenser can be a rotation of the outer circumferential case relative to the rest of the reusable towel dispenser. Also, the dispenser can include an outer circumferential casing of the reusable towel dispenser and an inner circumferential casing of the reusable towel dispenser, wherein the reusable towel holding compartment is defined between the inner circumferential casing and the outer circumferential casing.

In addition, the inner circumferential casing can define an inner hollow space which is open at either end of the reusable towel dispenser and which is configured to accommodate passage of a paper-towel holding rod configured to mount a paper-towel roll. The inner circumferential casing can define an inner hollow space which is open at either end of the reusable towel dispenser and which is configured to accommodate an ear-muff holder which is configured to mount a paper-towel roll. The dispenser may also include a middle circumferential casing such that the reusable towel holding compartment is defined by the inner circumferential casing and the middle circumferential casing. The reusable towel input can be an opening created by sliding the middle circumferential casing out of the outer circumferential case to expose an open portion of the middle circumferential casing.

Also, the reusable towel input can be an opening created by removal of a cap of the reusable towel dispenser. The dispenser can further include a portion which protrudes from the shape of the reusable towel dispenser. The portion of the reusable towel dispenser which protrudes from the shape of the reusable towel dispenser can protrude from a substantially cylindrical body of the reusable towel dispenser. The reusable towel output can be located on the portion which protrudes from the shape of the reusable towel dispenser. The reusable towel output can be configured to be angled such that an opening of the reusable towel output is open upward when the reusable towel dispenser is mounted for use. The reusable towel output can be configured to be angled such that an opening of the reusable towel output is open downward when the reusable towel dispenser is mounted for use.

Moreover, the reusable towel dispenser can be configured to be mounted on a rod which is configured to mount a paper-towel roll. The reusable towel dispenser can be configured to be mounted with an ear-muff holder which is configured to mount a paper-towel roll. The reusable towel output can include a first reusable towel output and a second reusable towel output of the reusable towel holding compartment. The second reusable towel output can be configured to enable a reusable towel of a group of non-structured reusable towels to be accessed and pulled, from the reusable towel holding compartment, out of the reusable towel dispenser.

Finally, the multiple reusable towels can be cotton towels. The reusable towel dispenser can be shaped substantially as a cylinder. The dispenser can additionally include a third reusable towel output of the reusable towel holding compartment, the third reusable towel output being configured to enable a reusable towel of a group of non-structured reusable towels to be accessed and pulled, from the reusable towel holding compartment, out of the reusable towel dispenser. The dispenser can also additionally include a fourth reusable towel output of the reusable towel holding compartment, the fourth reusable towel output being configured to enable a reusable towel of a group of non-structured reusable towels to be accessed and pulled, from the reusable towel holding compartment, out of the reusable towel dispenser. The first, second, third, and fourth reusable towel outputs can be spaced radially from one another.

The details of one or more implementations are set forth in the accompanying drawings and the description below. Other features will be apparent from the description, the drawings, and the claims.

Figure 1:
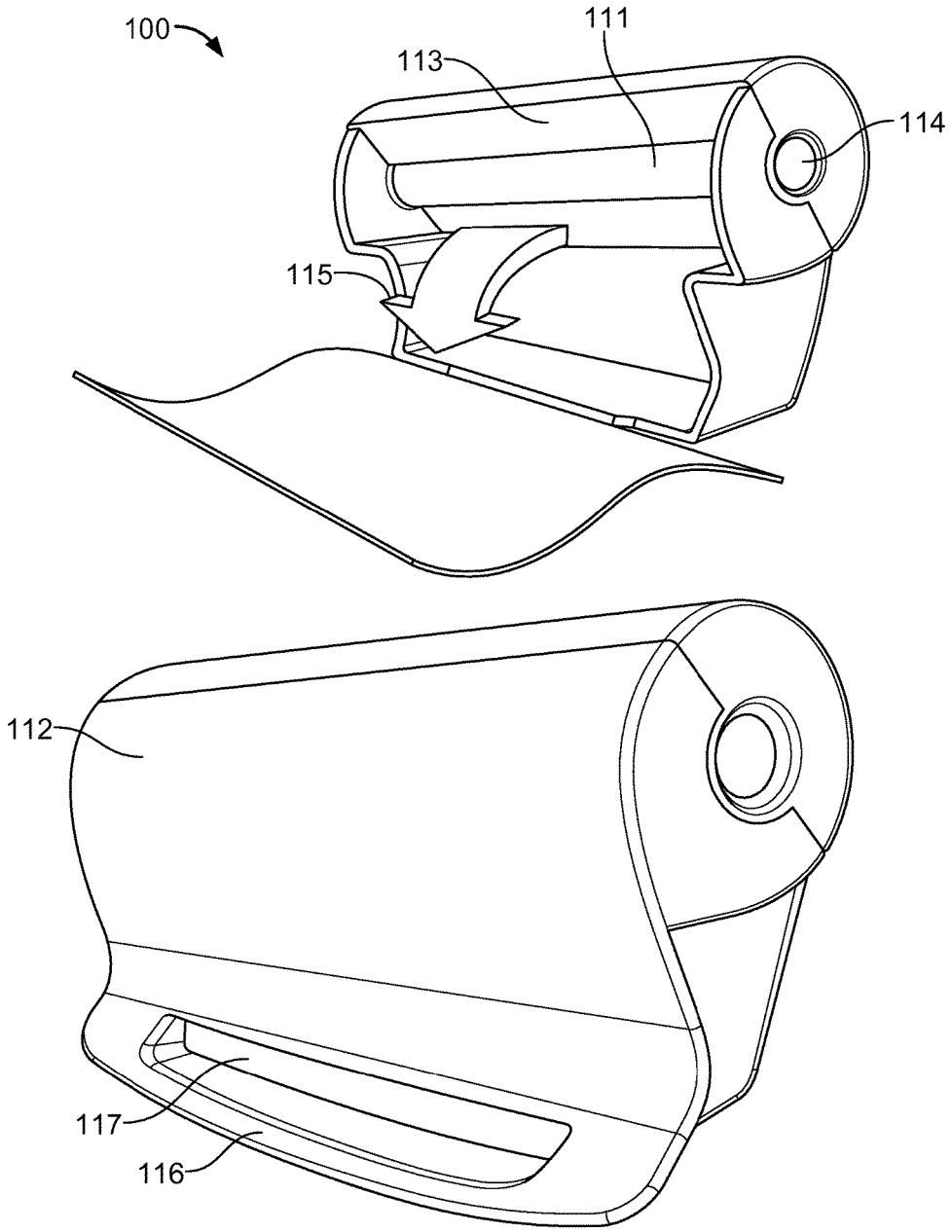
FIG. 1 is an example illustration of a reusable paper-towel holding apparatus with a protruding portion.

The details of one or more implementations are set forth in the accompanying drawings and the description below. Other features will be apparent from the description, the drawings, and the claims.

Like reference symbols in the various drawings indicate like elements.

DETAILED DESCRIPTION

Traditional paper-towels are paper-based tissues which are briefly used and then discarded. Therefore, all of the energy and resources used to manufacture, transport, sell, and dispose of each tissue goes towards a single use. In the aggregate, the environmental impact of a society reliant on disposable paper-towels is massive. Reusable paper-towels, however, can be manufactured out of various materials which can be washed without being destroyed. A paper-towel system allowing for the reuse of paper-towels could cut this environmental impact to a small fraction of its current state.

Paper-towels wrapped around a paper-towel roll are structured as a loosely connected number of sections which are tightly spiraled around a cylindrical center. This spiral structuring is put in place during manufacturing. Because the paper-towel roll requires each separate tissue to be connected in series, a consumer could not reuse the paper-towel roll as a dispenser for reusable paper-towels. Therefore, once the paper-towels are used, the paper-towels and the paper-towel roll are not reusable by the consumer and are all discarded.

Products like Kleenex™ tissues are sold in a container with the tissues disconnected and stacked on top of each other. The structure of the stacked tissues enables the tissues to be removed from a small opening without being replaced. The small opening is wide enough to allow passage of a tissue vertically with respect to the small opening, though not its length. Tissues can only be removed if directly pulled. As structured, each tissue is placed flat atop the preceding tissue and a portion of each tissue is folded into the proceeding tissue. As the tissue closest to the opening is removed, the next available tissue is pulled to expose an end which can also be easily removed through the small opening.

This structuring of Kleenex™ tissues is directed to a one-time use of disposable tissues. The small opening enables tissues to be removed but does not enable a consumer to replace a tissue once removed. Moreover, even if a consumer could somehow replace the tissue, the consumer would be forced to replicate the stacked and folded structure to be able to again easily remove the tissues through the small opening. It is not practical to expect consumers to fold small tissues in this manner. Therefore, these containers are not suitable for a reusable paper-towel system using conventional tissues.

In order to enable a consumer to easily use and reuse a reusable a paper-towel, a paper-towel container can be used which allows reusable paper-towels to be refilled without a particular structuring of the paper-towels. That is, a consumer can place an unorganized mass of cleaned paper-towels in the container even if the reusable paper-towels are not attached to each other in a spiral formation and are not placed flat on top of each other or interlaced. By not requiring a structuring of refilled paper-towels, the paper-towel container aids consumer adoption of reusable paper-towels.

Various materials can be used to construct the reusable paper-towels. For example, non-woven cotton can be manufactured relatively cheaply with various properties advantageous for use as a reusable paper-towel. In particular, non-woven cotton can be made to dry relatively quickly to prevent or limit development of mold after use. Also, non-woven cotton can be manufactured to be relatively coarse for scrubbing or relatively soft for comfort. Microfiber can also be used. Microfiber can be useful to avoid staining and for longevity. Reusable paper-towels can be color coded based on properties, such as materials, size, or shape. However, the size of the reusable paper-towel can be used to control the ease with which the reusable paper-towels are unloaded. For example, a towel size that is too large can promote a group of towels to wrap together such that a single towel is not easily separated. Moreover, a towel size that is too large can inhibit the ease with which a towel is removed from an opening of a reusable paper-towel apparatus. In contrast, a towel size that is too small can increase the likelihood that towels fall out or are otherwise accidentally removed from an opening of a reusable paper-towel apparatus. Therefore, a consumer can you use color identification to select one or multiple non-structured reusable paper-towels from a paper-towel container for a given situation.

One example of such a paper-towel container is the reusable paper-towel holding apparatus 100 with a protruding portion shown in FIG. 1. The apparatus 100 is configured to be loaded and reloaded with reusable paper-towels in a non-structured manner. In particular, the apparatus 100 can be loaded with reusable paper-towels that are not organized, folded, wrapped, or otherwise structured. The apparatus 100 includes an inner circumferential casing 111, an outer circumferential casing 112, a reusable paper-towel holding compartment 113, and a protruding portion 116.

The inner circumferential casing 111 can be configured to allow passage of a paper-towel roll holding-rod (not shown). In particular, the inner circumferential casing 111 can define an inner hollow space 114 which is open at either end. By being open at either end, a paper-towel roll holding-rod can pass through the inner hollow space 114 such that the apparatus 100 can be mounted on a paper-towel roll holder. The outer circumferential casing 112 largely surrounds the inner circumferential casing to define the paper-towel holding compartment 113.

The apparatus 100 enables reusable paper-towels to be reloaded with a front loading mechanism. In particular, the outer circumferential casing 112 is able to move with respect to the inner circumferential casing 111 to provide a large input opening 115 with which reusable paper-towels can be loaded into the paper-towel holding compartment 113. By using a front loading mechanism, the apparatus 100 may be easily reloaded without being removed from a mounting with a paper-towel holding-rod. To enable convenient loading when non-structured, the input opening 115 created by the front loading mechanism must be of a substantial size relative to the side-length of the reusable paper-towel. By being a substantial size, a group of reusable paper-towels can be conveniently loaded at the same time, even when clumped or otherwise disorganized. In some implementations, to enable ease of loading, the span of the input opening 115 created by the front loading mechanism should be large enough so that at least three clumped reusable paper-towels can be loaded. Particularly flexible or thin reusable paper-towels may be loaded with less span of the input opening 115 while particularly inflexible or thick reusable paper-towels may load easily only with more span of the input opening 115.

The outer circumferential casing 112 includes a protruding portion 116 which defines an output opening 117 to the reusable paper-towel holding compartment 113 which allows access to reusable paper-towels stored in the reusable paper-towel holding compartment 113. The output opening 117 serves as the primary mechanism from which reusable paper-towels are removed from the apparatus 100 for each use. Since the reusable paper-towels are pulled out of the apparatus 100 rather then being pushed in, the size required of the opening 117 is smaller than that required for the input opening 115 created by the front loading mechanism to load the apparatus 100. However, because the reusable paper-towels in the reusable paper-towel holding compartment 113 are not structured, the user may need to reach partially inside the apparatus 100 to grab on to a portion of a reusable paper-towel and remove it from the apparatus 100. Therefore, the output opening 117 can be made wide enough to allow a portion of a thumb and finger to pass, such as a span of one to two inches. The output opening 117, however, is generally not made significantly larger than required to prevent reusable paper-towels from unintentionally falling or sliding out of the apparatus 100.

The output opening 117 is located on the bottom of the apparatus 100, as mounted. This location allows gravity to progressively move reusable papers towards the output opening 117 as the reusable paper-towels are withdrawn. In particular, when filled, reusable paper-towels fill much of the volume of the reusable paper-towel compartment 113. As reusable paper-towels are removed from the apparatus 100, an empty space is made at the bottom of the apparatus 100. Due to gravity, the reusable paper-towels fall toward the bottom of the apparatus 100, filling the empty space and placing additional reusable paper-towels close to the output opening 117 for ease of removal. As shown, the output opening 117 is located at the bottom of the apparatus 100 but does not open to expose the underside of the apparatus 100. Also, the output opening 117 is not oriented vertically as mounted. Rather, the output opening is positioned at approximately a 45 degree angle above a horizontal planar direction. This non-vertical and non-horizontal positioning of the output opening 117 further minimizes the unintentional removal of reusable paper-towels. Also, this non-horizontal position of the output opening 117 enables a somewhat larger width of the output opening 117 while minimizing unintentional removal than would be enabled if the output opening 117 exposed the underside of the apparatus 100.

The above description of the apparatus 100 as well as the below description of additional features are examples. Other implementations may be configured differently and with different features. For example, other implementations of the apparatus 100 may include a substantially cone shape with the output opening 117 at the bottom of the apparatus 100 to emphasize the use of gravity in bringing towels closer to the output opening 117.

Figure 2:
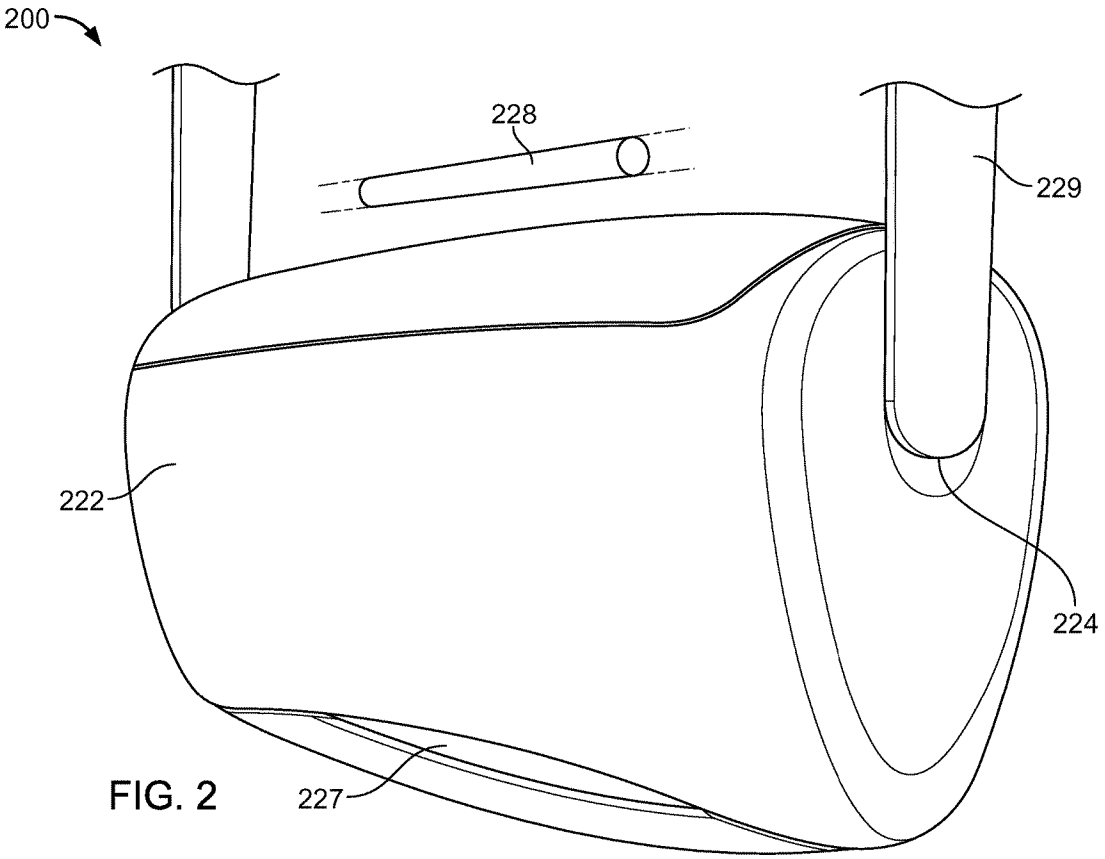
FIG. 2 is an example illustration of a reusable paper-towel holding apparatus without a protruding portion.

FIG. 2 is an example illustration of a reusable paper-towel holding apparatus 200 without a protruding portion 116. In particular, the apparatus 200 includes an exit opening 227 with a near vertical orientation and not protruding from the apparatus 200. Also, the apparatus 200 includes an outer circumferential casing 222 that defines mounting openings 224 which, as shown, are covered by ear-muff holders 229. The apparatus 200 includes a top loading mechanism by allowing a top piece of the outer circumferential casing 222 to be removed, providing a large input opening (not shown) with which reusable paper-towels can be loaded into the paper-towel holding compartment.

The apparatus 200 is configured to be mounted using ear-muff holders 229 without necessarily passing a paper-towel holding-rod 228 through the apparatus 200. In particular, the outer circumferential casing 222 defines mounting openings 224 which can be used to allow passage of a paper-towel holding-rod 228 (similar to the inner circumferential casing 111 of FIG. 1), to allow locking by ear-muff holder 229, or both. Locking by ear-muff holders 229 can include placing a short indented knob onto the mounting openings 224 at either end of the apparatus 200 and holding the knobs into the mounting openings 224 with a constant inward pressure. The apparatus 200 enables reusable paper-towels to be reloaded with a top loading mechanism which creates a large input opening with which reusable paper-towels can be loaded into the paper-towel holding compartment (not shown).

The outer circumferential casing 222 defines an output opening 227 to the reusable paper-towel holding compartment which allows access to reusable paper-towels stored in the reusable paper-towel holding compartment, but does not include a protruding portion 116. Similar to FIG. 1, the output opening 227 is located on the bottom of the apparatus 200, as mounted, to allow gravity to progressively move reusable papers towards the output opening 227 as the reusable paper-towels are withdrawn. Also, the output opening 227 is angled substantially vertically as mounted. This substantially vertical, not on a protruding portion, positioning can allow convenient access to the reusable paper-towels if the apparatus 200 is mounted at a significant vertical height. For example, if a paper-towel holder with ear-muffs is mounted on the underside of a kitchen counter or at chest level on a public bathroom wall, the height of the apparatus 200 may result in easier access to reusable paper-towels with the positioning of the output opening 227 than with the positioning of the output opening 117. However, the span of the output opening 227 may be somewhat smaller than the span out output opening 117 to have a more substantial effect on preventing unintentional removal of reusable paper-towels.

Figure 3A:
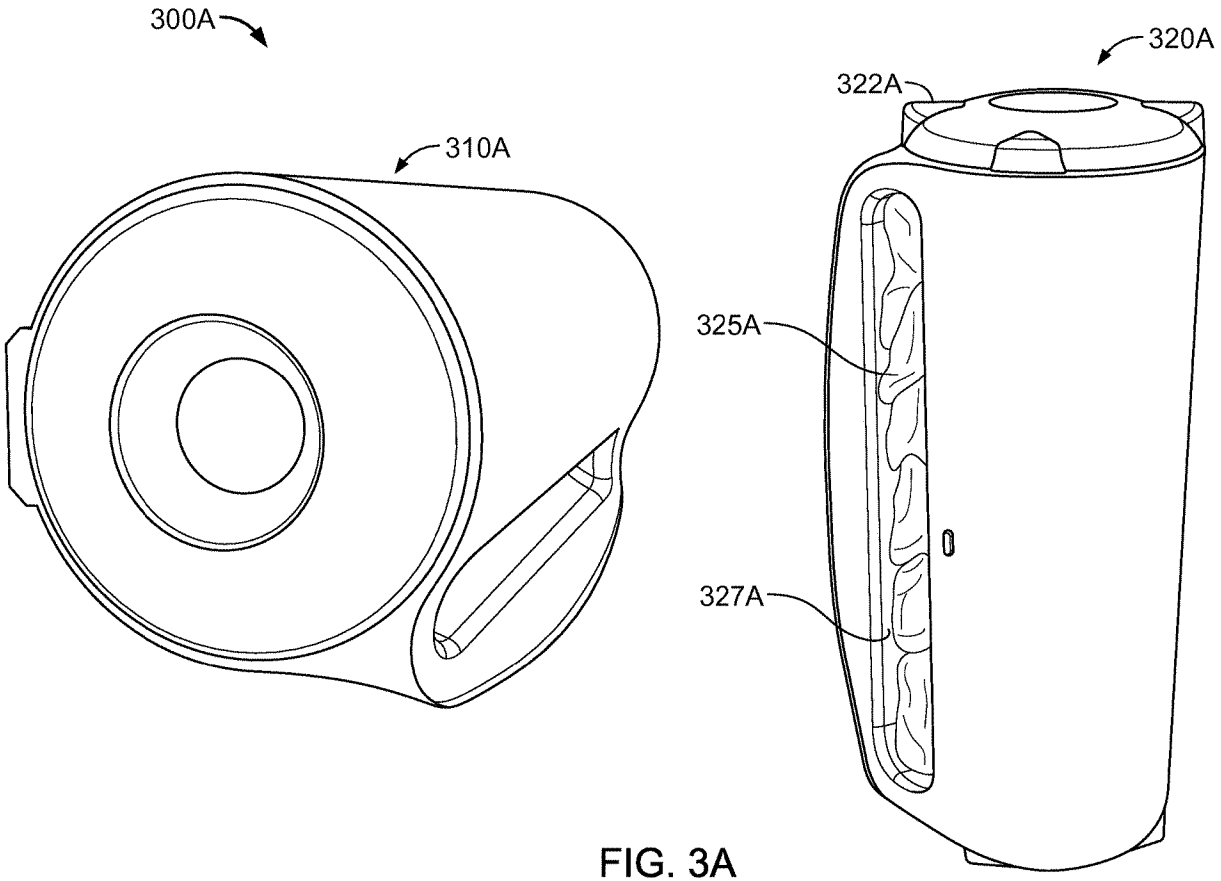
FIGS. 3A-3B are example illustrations of reusable paper-towel holding apparatuses configured to allow reuse of paper-towels while functioning as conventional paper-towel rolls.
Figure 3B:
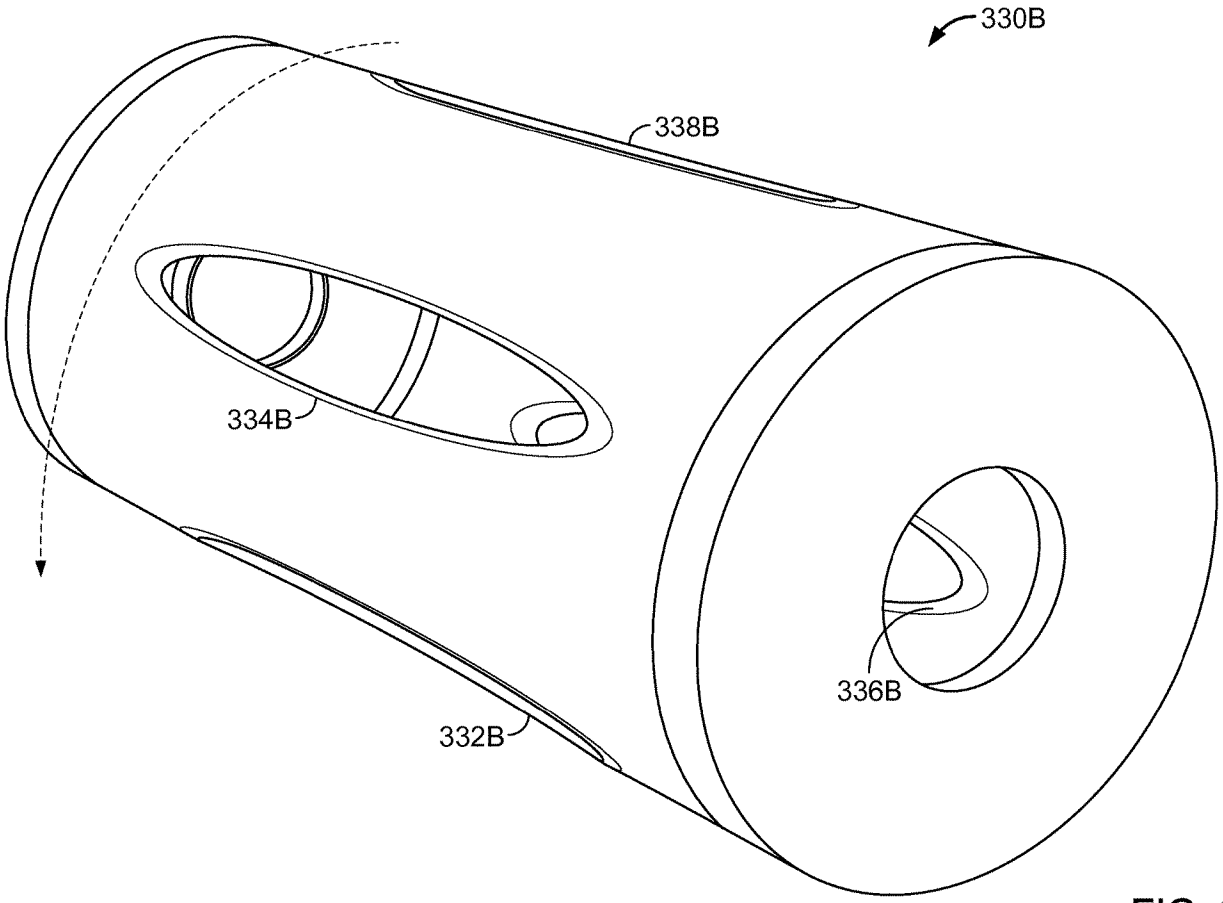

FIGS. 3A-3B are example illustrations of reusable paper-towel holding apparatuses configured to allow reuse of paper-towels while functioning as conventional paper-towel rolls.

FIG. 3A is an example illustration of a reusable paper-towel holding apparatus 300A horizontally 310A and vertically 320A which is configured to allow reuse of paper-towels while functioning as a conventional paper-towel roll. The apparatus 300A has an outer circumferential casing 322A which is substantially cylindrical in shape so as to mimic the size of a conventional paper-towel roll. As such, the apparatus 300A is able to be mounted with many devices configured to mount conventional paper-towel rolls. The ends 322A of the cylinder can have flattened portions or ridges to increase stability when placed vertically. As shown, the vertically placed apparatus 320A is filled with reusable paper-towels 325A. The reusable paper-towels 325A are not structured, but, rather, are placed in the apparatus 320A in a disorganized fashion. As discussed above, an output opening 327A is configured to minimize occurrence of the paper-towels unintentionally falling or sliding out of the apparatus 320A.

FIG. 3B is an example illustration of a reusable paper-towel holding apparatus 300B with multiple output openings 332B-338B to allow for reuse of paper-towels while functioning as a conventional paper-towel roll. In particular, the apparatus 300B include four output openings 332B-338B which are equally spaced along a radius of the apparatus 300B. Other implementations can include a greater or fewer number of output openings. A larger number of output openings may enhance the functionality described below, while a smaller number of output openings may be used to simplify manufacturing and design. The multiple output openings 332B-338B can allow for ease of extraction of reusable paper-towels from the paper-towel holding apparatus 300B.

In some implementations, the mounted apparatus 300B is able to be rotated, similar to a conventional paper-towel role. Therefore, including only a single output opening would require the user to rotate the apparatus 300B such that the single output opening is in front of the user in order to extract a reusable paper-towel. However, the multiple output-openings 332B-338B shown in FIG. 3B allow for minimal (e.g., less than 90 degrees) rotation of the apparatus 300B to extract a reusable paper-towel. In this manner, various implementations of the apparatus 300B are more convenient to a user than a conventional paper-towel roll, as only minimal rotation of the apparatus 300B is required.

Also, regardless of whether the apparatus 300B can be rotated, the multiple output openings 332B-338B can allow for the user to extract reusable paper-towel from multiple directions, as mounted. Therefore, in any given situation, extraction of a reusable paper-towel is more likely to be convenient to a user than extraction with an apparatus with only a single output opening. This feature can be particularly useful for reusable paper-towel mounts which do not allow for rotation of a reusable paper-towel holding apparatus after mounting. The apparatus 300B can also be mounted with a paper-towel holding rod, ear-muffs, or other mounting styles discussed above and below.

Figure 4A:
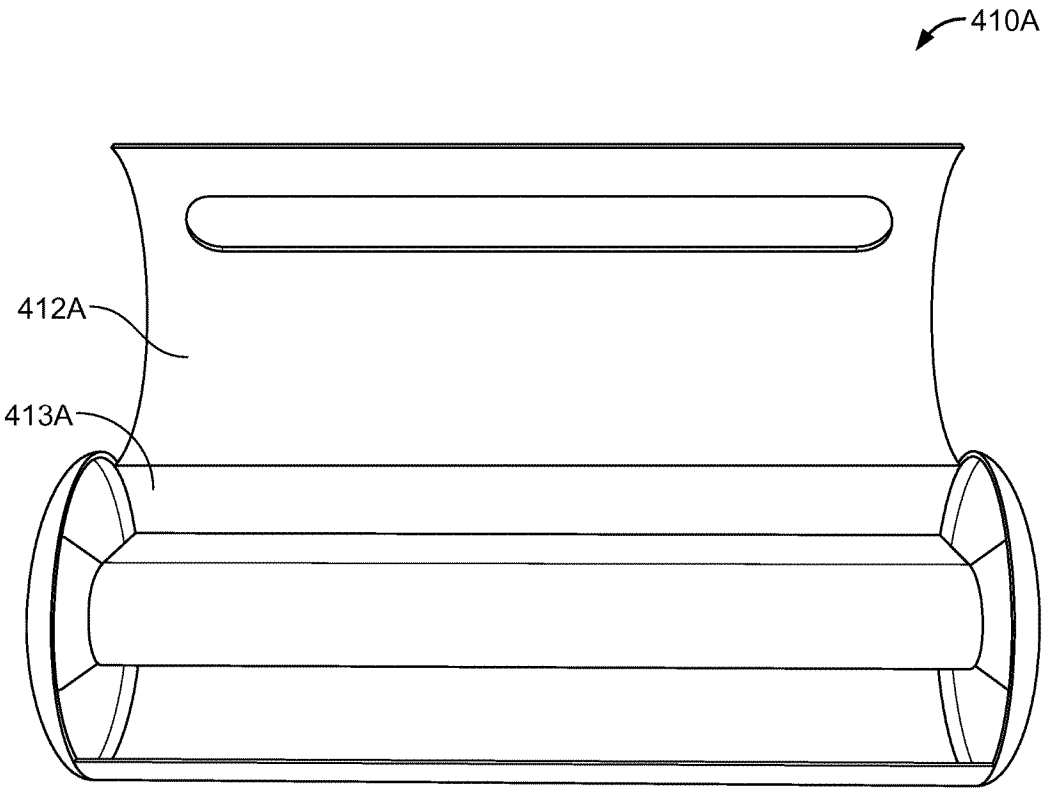
FIGS. 4A-4C are example illustrations of loading mechanisms for a reusable paper-towel holding apparatus.
Figure 4B:
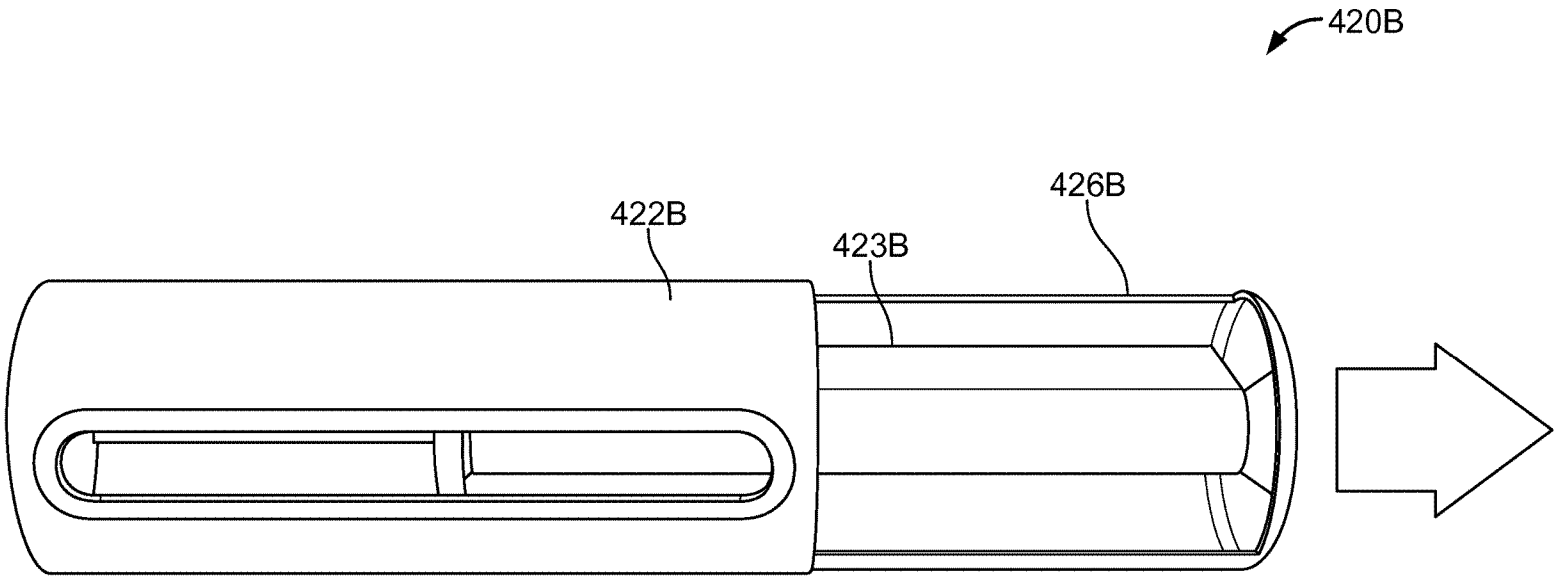
Figure 4C:
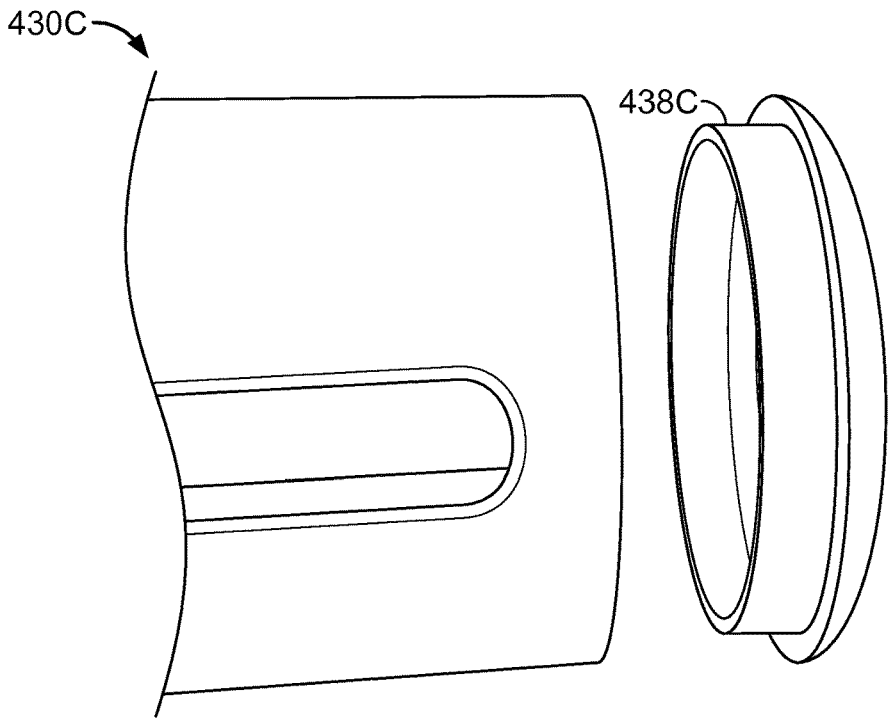

FIGS. 4A-4C are example illustrations of loading mechanisms for a reusable paper-towel holding apparatus. The loading mechanisms of FIGS. 4A-4C can be used with the apparatuses of FIGS. 1-3.

FIG. 4A shows an apparatus 410A configured to enable loading of reusable paper-towels by lifting the outer circumferential casing 412A. In particular, the outer circumferential casing 412A is initially held in place through frication or a locking mechanism (not shown) to provide an enclosed reusable paper-towel holding compartment 413A. To reload the apparatus 410A, the consumer opens the outer circumferential casing 412A to expose the reusable paper-towel holding compartment 413A and then places the reusable paper-towels in the apparatus 410A. This loading mechanism can allow for particularly quick loading as compared to various other mechanisms as it exposes the majority of the reusable paper-towel holding compartment 413A for loading. Also, this loading mechanism can enable loading of the apparatus 410A while the apparatus is mounted with both ends in a paper-towel holding-rod or with ear-muff holders.

FIG. 4B shows an apparatus 420B configured to enable loading of reusable paper-towels by sliding. In the apparatus 420B, a middle circumferential casing 426B is initially held in place through friction or a locking mechanism (not shown) to provide an enclosed reusable paper-towel holding compartment 423B. The middle circumferential casing 426B is not a fully enclosed cylinder as it includes an open face. To reload the apparatus 420B, the consumer slides the middle circumferential casing 426B with respect to an outer circumference casing 412B and out of the end of the apparatus 420B. As the middle circumferential casing 426B slides out of the apparatus 420B, the open face is exposed. The consumer then inserts the reusable paper-towels through the open face and into the middle circumferential casing 426B and slides the middle circumferential casing 426B back into the apparatus 420B. This loading mechanism can allow for ease of loading the apparatus 420B without requiring significant additional space with respect to the radius of the apparatus 420B. For example, if mounted under a surface such as the bottom of a cabinet, space may not be available to lift the outer circumferential casing 422B without fully removing the apparatus 420B from its mount (i.e., without removing mounting attachments at both ends of the apparatus 420B).

FIG. 4C shows an apparatus 430C configured to enable loading of reusable paper-towels by use of an end-cap 438C. The end-cap 438C is initially held in place closing off the end of the apparatus 430C through friction or a locking mechanism (not shown). To reload the apparatus 430C, the consumer removes the end-cap 438C to expose a reusable paper-towel holding compartment. The consumer then inserts the reusable paper-towels in the reusable paper-towel holding compartment and replaces the end-cap 438C. This loading mechanism can also allow for ease of loading the apparatus 430C without requiring significant additional space with respect to the radius of the apparatus 430C. Also, this loading mechanism can allow for increased efficiency in reloading. In particular, by only opening an end of the cylinder, it can be easier for a consumer to more completely fill the space of the reusable paper-towel holding compartment when loading a group of reusable paper-towels.

As discussed above, a reusable paper-towel holding apparatus may not be shaped identically to a conventional paper-towel roll. Nevertheless, it may be convenient for a user to mount the reusable paper-towel holding apparatus on a conventional paper-towel holding-rod. FIGS. 5-9D are example illustrations of mounting mechanisms for mounting a reusable paper-towel holding apparatus to a conventional paper-towel holding-rod. The mounting mechanisms may be used in conjunction with the apparatuses of, for example, FIGS. 1-4C. Reusable paper-towel holding apparatuses that are able to be mounted like conventional paper-towel rolls can be easily replaced like conventional paper-towel rolls. In some cases, reusable paper-towel apparatus may be designed with the intention that the apparatus will be removed from a holder once emptied of reusable paper-towels and replaced with a second reusable paper-towel holding apparatus which is loaded with further reusable paper-towels. In this manner, a removed reusable paper-towel holding apparatus can be later refilled at a user's convenience while the second reusable paper-towel holding apparatus includes further reusable paper-towels that are immediately available.

The mounting mechanisms of FIGS. 5-9D can be placed at opposing ends of the reusable paper-towel holding apparatus, either inside or outside of the apparatus. In one implementation, the mounting mechanisms are placed on end caps. The mounting mechanisms can be configured to be operated through, for example, twisting of a cap, pressing of a lever or button, applying force directly on the mechanism, or through other means.

Figure 5:
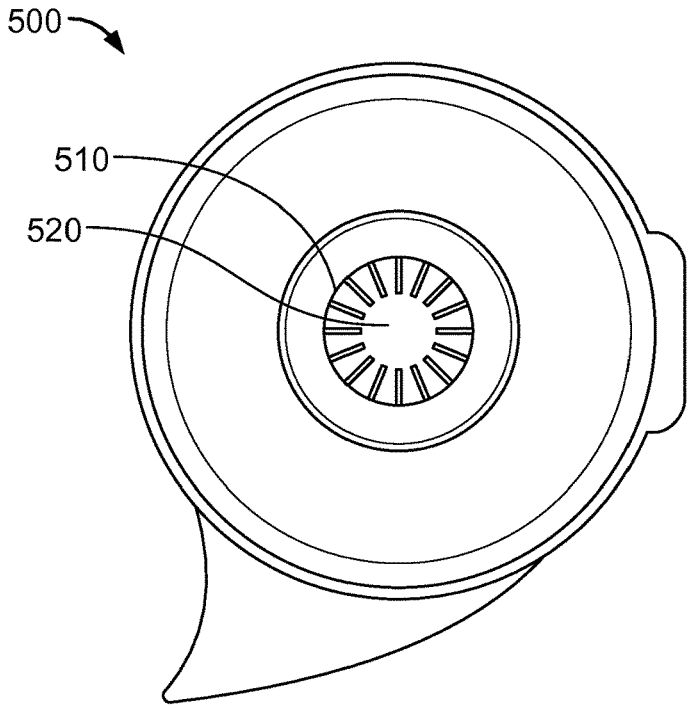
FIG. 5 is an example illustration of a reusable paper-towel holding apparatus which is configured to be mounted on a paper-towel holding-rod through use of a fitted center.

FIG. 5 is an example illustration of a reusable paper-towel holding apparatus 500 which is configured to be mounted on a paper-towel holding-rod through use of a fitted center. The fitted center includes a flexible circumference 510 which surrounds a hollow cylinder 520. This flexible circumference 510 can be made out of plastic, rubber, or another elastomer formed to have a hollow center in which a paper-towel holding-rod can slide through.

The flexible circumference 510 may be formed with such dimensions that the paper-towel holding-rod presses against the flexible circumference 510 when slid through the hollow cylinder 520. In general, the diameter of the hollow cylinder 520 may be slightly larger to slightly smaller than the diameter of a paper-towel holding-rod. A diameter of the hollow cylinder 520 which is about the same size or slightly smaller than the diameter of a paper-towel holding-rod can be used to create a pressure from the flexible circumference 510 on the paper-towel holding-rod. The pressure on the paper-towel holding-rod can create friction which keeps the reusable paper-towel holding apparatus 500 in place on a paper-towel holding-rod. Moreover, the surface of the flexible circumference 510 may be uneven or ruff to augment the amount of friction.

Figure 6A:
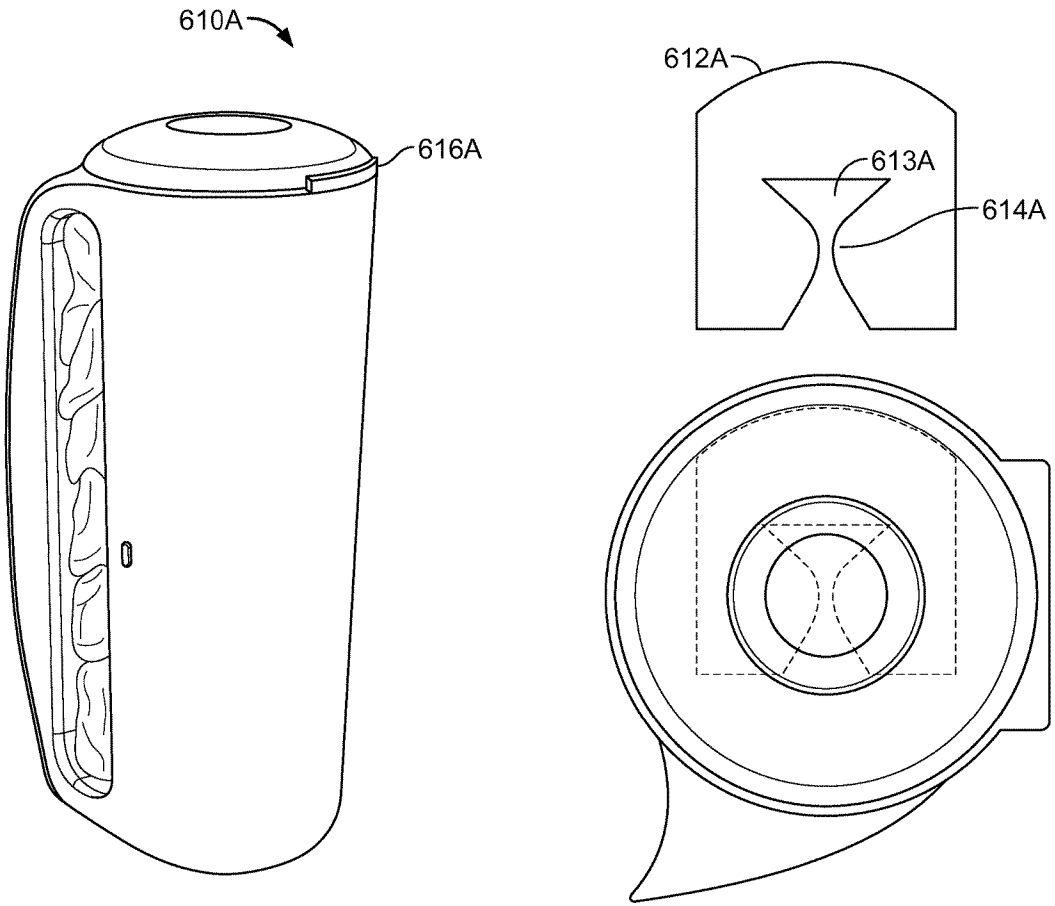
FIGS. 6A & 6B are example illustrations of reusable paper-towel holding apparatuses which are configured to be mounted on a paper-towel holding-rod through use of a holding-rod clamp.

FIG. 6A is example illustration of a reusable paper-towel holding apparatus 610A which is configured to be mounted on a paper-towel holding-rod through use of a holding-rod clamp 612A. The holding-rod clamp 612A can be made out of plastic, rubber, or another elastomer formed to maintain a permanent semi-flexible shape with a protruding portion 614A adjacent to a crevice 613A.

When a paper-towel holding-rod is pushed into the protruding portion 614A, the semi-flexible shape responds by opening slightly, enabling the rod to be mounted securely inside the crevice 613A. A further force is required to pull the paper-towel holding-rod out of the mounting in the crevice 613A. The holding-rod clamp 612A can be placed at the ends of the reusable paper-towel holding apparatus 610A. In one implementation, the holding-rod clamp 612A is configured to be mounted on the paper-towel holding-rod by being pushed inward towards the center of the device. Once pushed inward, the holding-rod clamp 612A is even with the surface 616A of the reusable paper-towel holding apparatus 610A such that the holding-rod clamp 612A exhibits no profile.

Figure 6B:
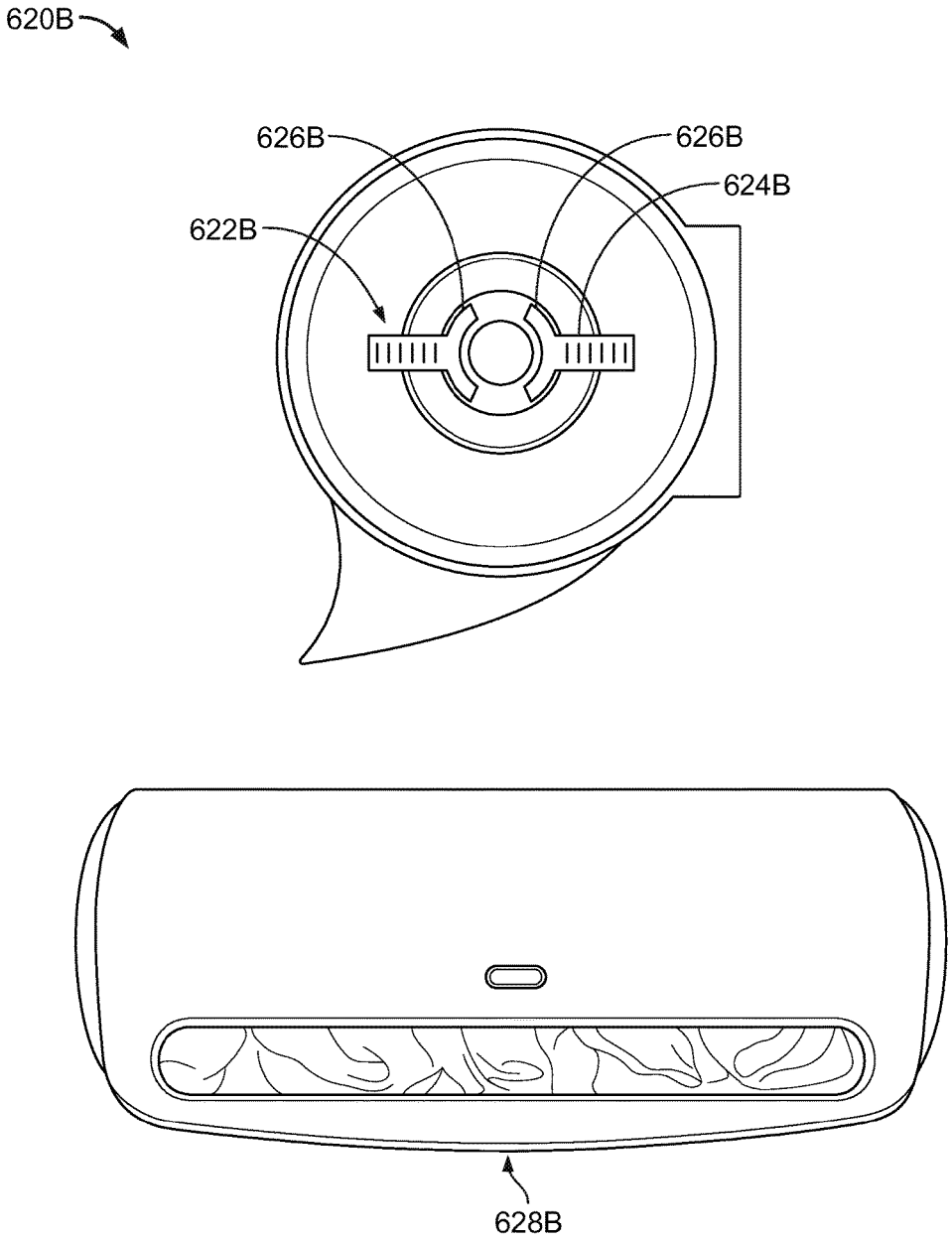

FIG. 6B is example illustration of a reusable paper-towel holding apparatus 620B which is configured to be mounted on a paper-towel holding-rod through use of a holding-rod clamp 622B with teeth 624B and end-pieces 626B. The holding-rod clamp 622B is configured such that the end-pieces 626B can be pushed inward while their position is incrementally locked by the teeth 624B. The end pieces 626B can be pushed inward by, for example, turning of a cap, pressing of a leveler, or through other means. Also, as they are pushed inward, the end-pieces 626B can be pushed around a paper-towel-holding-rod.

The teeth 624B can then be used to lock the end-pieces 626B in the pressed inward position such that they are pressed around the paper-towel-holding-rod. When locked by the teeth 624B, the end-pieces 626B can apply a pressure to the paper-towel holding-rod. In this manner, a reusable paper-towel holding apparatus 620B can be mounted on a paper-towel holding-rod. The locking by the teeth 624B can later be reversed through a further user manipulation of, for example, a cap or lever. In some implementations, the end-pieces 626B are made out of a flexible material and flex partly around the paper-towel holding-rod when forced.

Figure 7A:
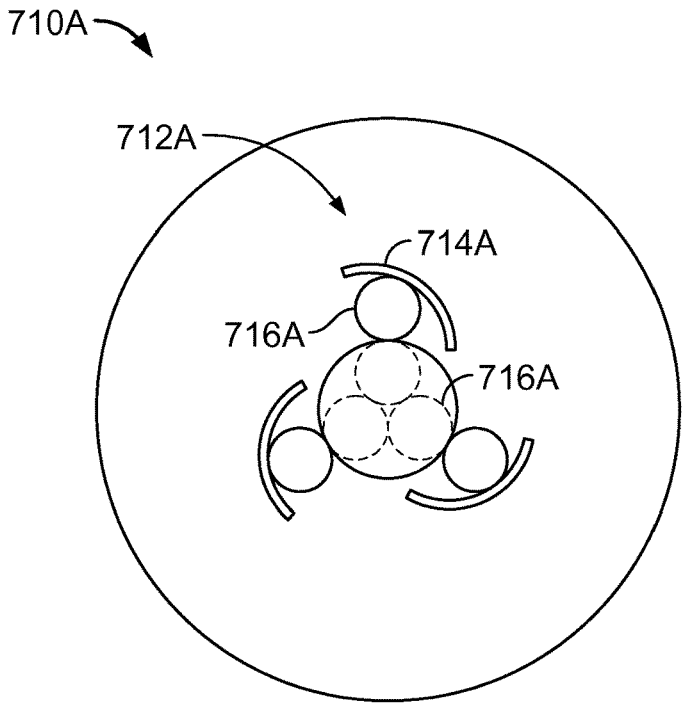
FIG. 7A-7C are example illustrations of reusable paper-towel holding apparatuses which are configured to be mounted on a paper-towel holding-rod through use of a holding-rod fastener.

FIG. 7A is an example illustration of a reusable paper-towel holding apparatus 710A which is configured to be mounted on a paper-towel holding-rod through use of a holding-rod fastener 712A. In particular, the holding-rod fastener 712A includes arm pieces 714A adjacent to round pieces 716A. The arm pieces 714A and round pieces 716A can be made out of various metals, plastics, or rubber. In one implementation, however, the arm pieces 714A are made out of plastic while the round pieces 716A are made out of plastic and coated with rubber.

User manipulation by, for example, the twisting of a cap or pressing of a button or lever is used to create a pressure on the arm pieces 714A. This pressure on the arm pieces 714A presses the adjacent round pieces 716A inward. As the round pieces 716A are pressed inward, the round pieces 716A are pushed against a paper-towel holding-rod which has been slid through the hollow center of the reusable paper-towel holding apparatus 710A. The pressure between the round pieces 716A and the paper-towel holding-rod is used to mount the reusable paper-towel holding apparatus 710A on the paper-towel holding-rod.

Figure 7B:
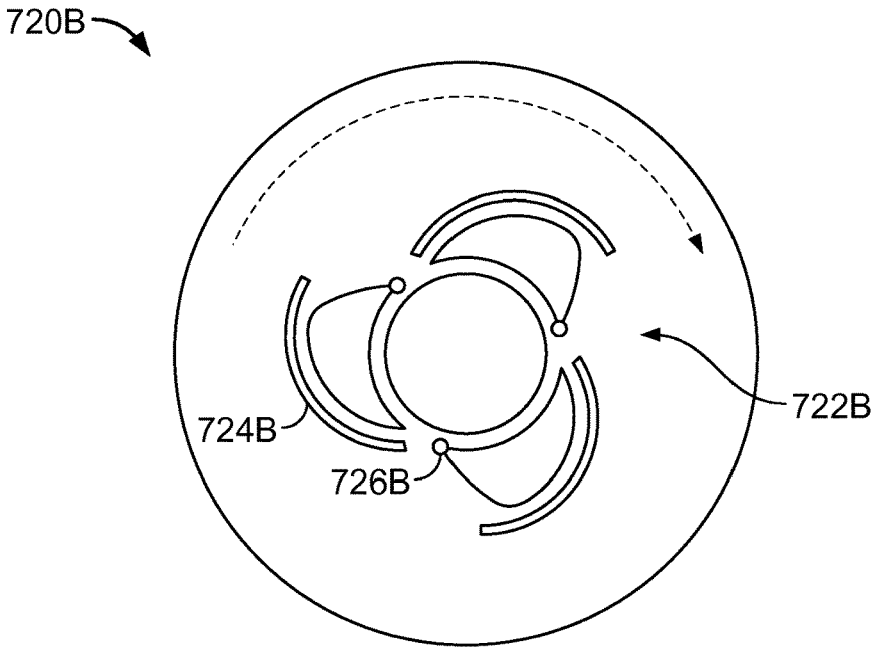

FIG. 7B is an example illustration of a reusable paper-towel holding apparatus 720B which is configured to be mounted on a paper-towel holding-rod through use of a holding-rod fastener 722B. In particular, the holding-rod fastener 722B includes arm pieces 724B adjacent to spring pieces 726B. As a pressure is created on the arm pieces 724B, the adjacent spring pieces 726B are pushed inward. As they move inward, the spring pieces 726B are pushed against a paper-towel holding-rod, thereby creating friction. The further in they are pushed, the greater the responsive pressure from the spring pieces 726B. In some implementations, a cap (not shown) is placed over the arm pieces 724B. As the cap is turned, pressure is applied to the arm pieces 724B which, in turn, applies inward pressure to the spring pieces 726B. The pressure between the spring pieces 726B and a paper-towel holding-rod is used to mount the reusable paper-towel holding apparatus 720B on the paper-towel holding-rod. A locking mechanism, such as teeth (not shown), can be used to latch the holding-rod fastener 722B such that the spring pieces 726B place pressure on a paper-towel holding-rod.

Figure 7C:
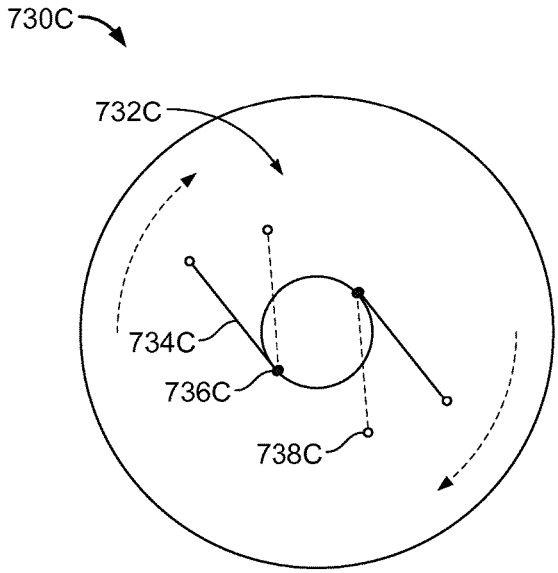

FIG. 7C is an example illustration of a reusable paper-towel holding apparatus 730C which is configured to be mounted on a paper-towel holding-rod through use of a holding-rod fastener 732C. In particular, the holding-rod fastener 732C includes arm pieces 734C with inner fixed ends 736C and outer ends 738C. The inner fixed ends 736C are fixed to a portion at or near the inner surface of the hollow cylinder in which the paper-towel hold-rod slides through. The outer ends 738C can rotate with respect to an outer rotatable structure, such as an inner surface of a cap (not shown). As the outer rotatable structure, or cap, is rotated, the outer ends 738C are rotated circumferentially around the hollow cylinder. This rotation moves the arm pieces 734C inwards against a paper-towel holding-rod, thereby creating pressure between the paper-towel holding-rod and the arm pieces 734C. This pressure is used to mount the reusable paper-towel holding apparatus 730C on the paper-towel holding-rod. Reversible locking teeth, such as those shown in FIG. 6B can be used to lock the arm pieces 734C in place. In one implementation, the arm pieces 734C are formed as rubber. In another implementation, the arm pieces 734C are formed as a metal bar surrounded by rubber.

Figure 8A:
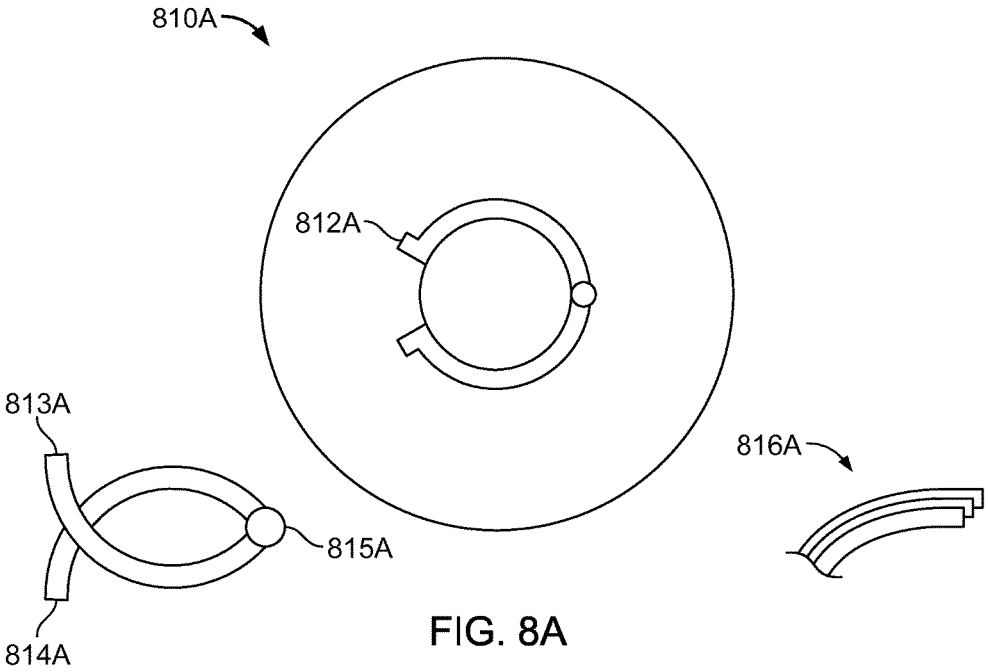
FIGS. 8A & 8B are example illustrations of reusable paper-towel holding apparatuses which are configured to be mounted on a paper-towel holding-rod through use of a holding-rod clasp.

FIG. 8A is an example illustration of a reusable paper-towel holding apparatus 810A which is configured to be mounted on a paper-towel holding-rod through use of a holding-rod clasp 812A. The holding-rod clasp 812A includes two opposing arms 813A and 814A and a common spring 815A. In some implementations, the opposing arms 813A and 814A each comprise a set of several arms 816A. The use of a set of several arms 816A as the arm 813A and as arm 814A can provide additional strength and security to the mount.

The spring 815A is configured to continuously apply pressure forcing the opposing arms 813A and 814A together. In some implementations, the opposing arms 813A and 814A are metal so as to ensure strength. In other implementations, the opposing arms 813A and 814A are rubber or plastic, so as to maintain flexibility.

To operate the holding-rod clasp 812A, the opposing arms 813A and 814A are pulled apart to create an opening in which the paper-towel holding-rod can slide through. The opposing arms 813A and 814A can be pulled apart through, for example, turning of a cap, pressing of a leveler, direct user manipulation, or through other means. Once the paper-towel holding-rod is slid through, the opposing arms 813A and 814A are released. Thereafter, the pressure created by the spring 815A forces the opposing arms 813A and 814A to wrap around and place pressure on the paper-towel holding-rod. This pressure is used to mount the reusable paper-towel holding apparatus 810A on the paper-towel holding-rod.

Figure 8B:
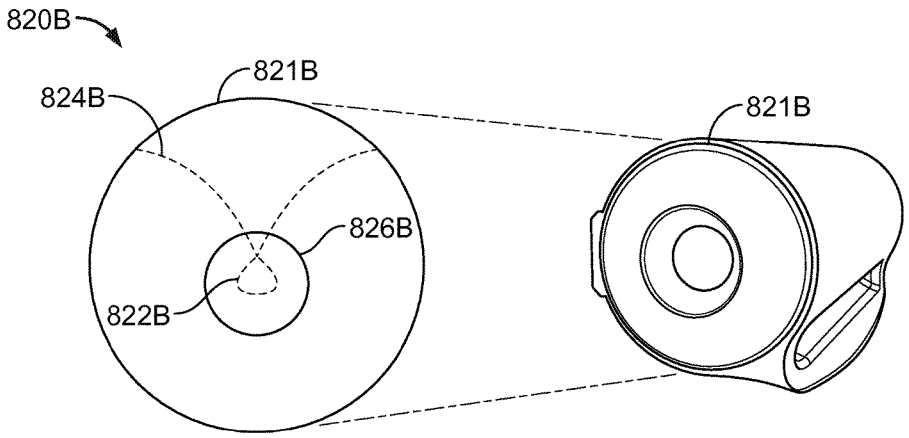

FIG. 8B is an example illustration of a reusable paper-towel holding apparatus 820B which is configured to be mounted on a paper-towel holding-rod through use of a holding-rod clasp 822B. The holding-rod clasp 822B is formed with a flexible cable 824B, such as a metal spring or rubber line. In general, the flexible cable is operated to create a loop that is within or over the outside of a hollow cylinder 826B through the reusable paper-towel holding apparatus 820B. As a paper-towel holding-rod is slid through the hollow cylinder 826B, it is also passed through the loop. Thereafter, the loop is tightened such that the loop shrinks and squeezes the paper-towel holding-rod.

In one implementation, the holding-rod clasp 822B is formed with a metal spring that includes a rubber grip. The metal spring is formed to continuously apply pressure to shrink the loop. To insert the paper-towel holding-rod through the loop, the user must first operate a cap or lever to force open the spring, increasing the size of the loop. Thereafter, the user releases the cap or lever and the metal spring returns to its original shape, squeezing the paper-towel holding-rod.

In another implementation, the holding-rod clasp 822B is formed with a rubber line. As mounted on the reusable paper-towel holding-rod apparatus, the rubber line maintains a loop larger than a paper-towel holding-rod, enabling a user to simply insert the paper-towel holding-rod through the loop. Thereafter, the user must operate a cap or lever connected to locking teeth to tighten the loop. The tightened loop squeezes the paper-towel holding-rod.

FIGS. 9A-9D are example illustrations of reusable paper-towel holding apparatuses which are configured to be mounted on an ear-muff style paper-towel holder. The reusable paper-towel holding apparatus 910A of FIG. 9A includes a flexible cable 912A. Initially, the flexible cable 912A can be tucked into the cap or otherwise maintained internally 914A. The flexible cable 912A is connected to a spring loaded rod (not shown) which pulls the flexible cable 912A into the reusable paper-towel holding apparatus 910A. When pulled outward, the flexible cable 912A can be wrapped around the end 916A of an ear-muff style paper-towel holder 915A. Thereafter, a spring-loaded rod reclaims the slack of the flexible cable 912A. The reusable paper-towel holding-rod then hangs from the ear-muff style paper-towel holder 915A.

Figure 9A:
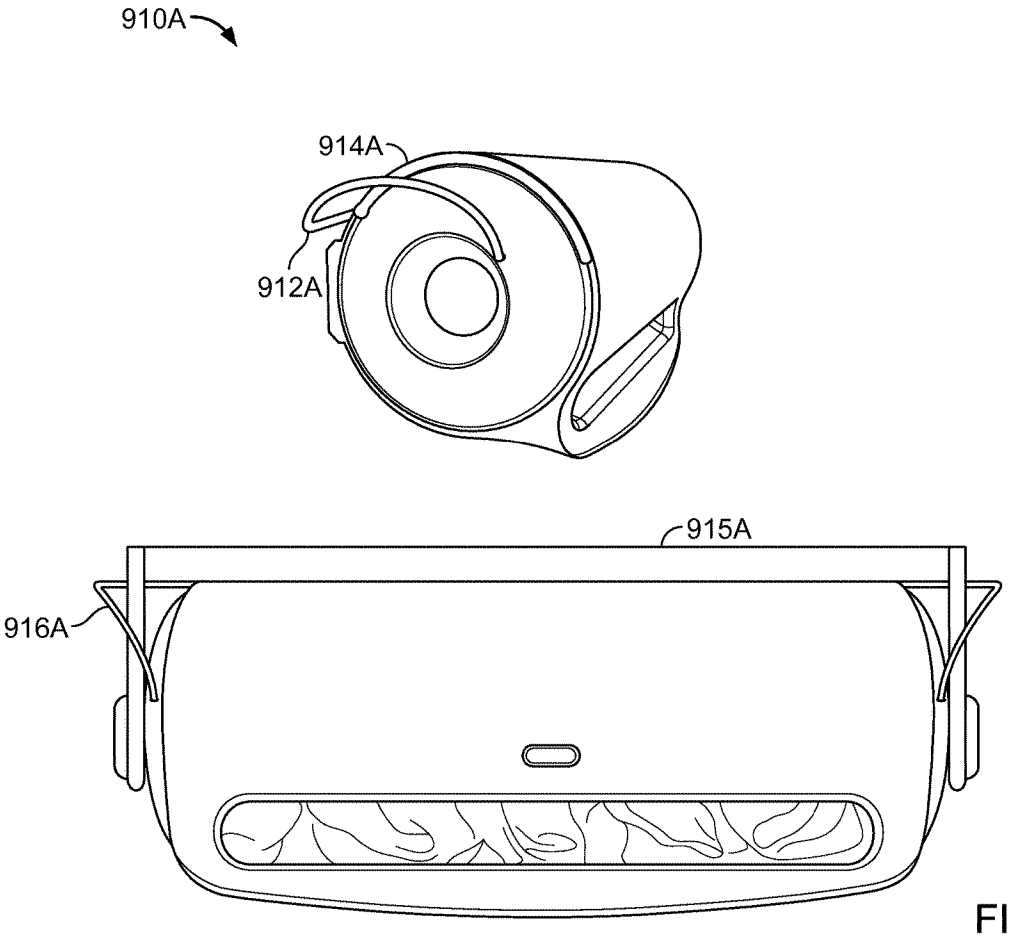
FIGS. 9A-9D are example illustrations of reusable paper-towel holding apparatuses which are configured to be mounted on an ear-muff style paper-towel holder.
Figure 9B:
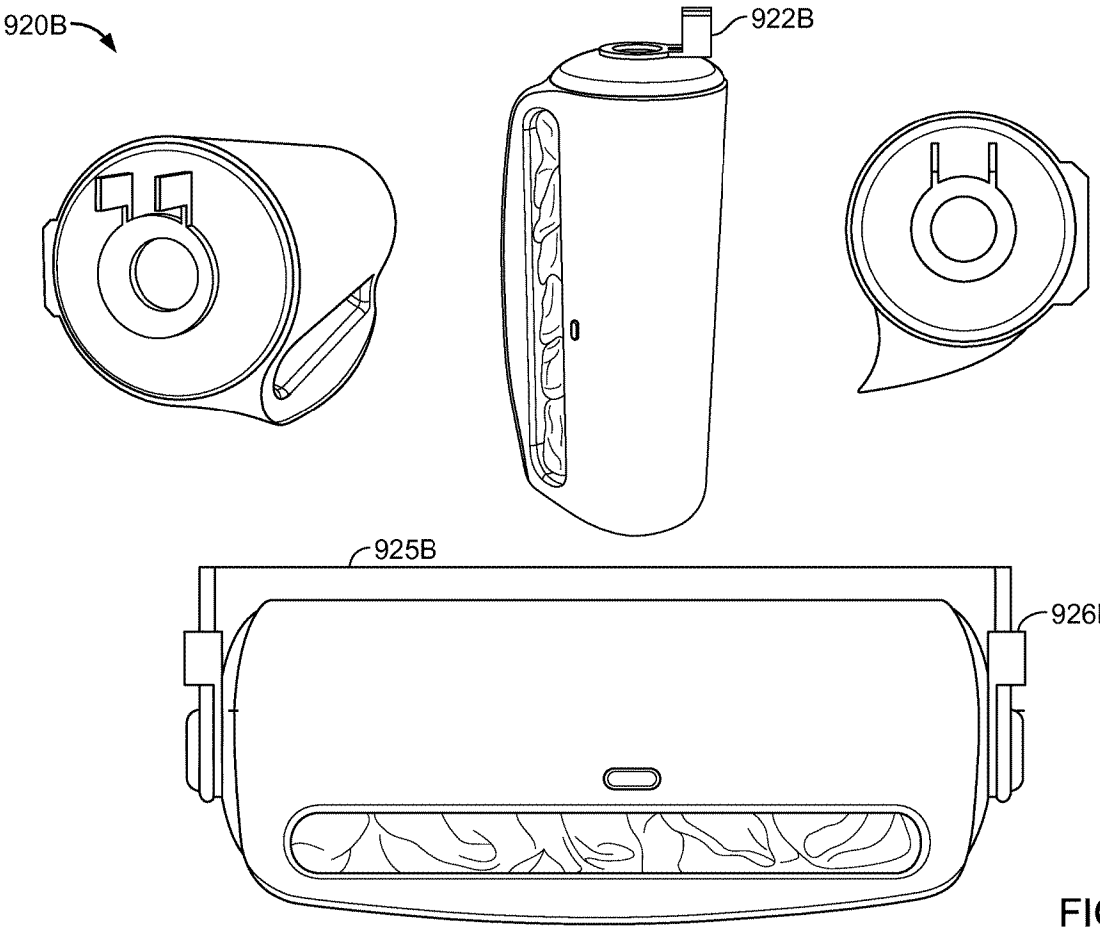

The reusable paper-towel holding apparatus 920B of FIG. 9B includes tabs 922A which are used to attach the reusable paper-towel holding apparatus 920B to an ear-muff style paper-towel holder 925B. The tabs 922A can be configured to be spring loaded, such that the springs push the tabs into ends 926B of an ear-muff style paper-towel holder 925B when mounted. In other implementations, tabs 922A can be made from a material which provides some inherent flexibility while maintaining a permanent shape, such as, for example, plastic or rubber. In this manner, the tabs 922A can be attached to the ends 926B of the ear-muff style paper-towel holder 925B.

Figure 9C:
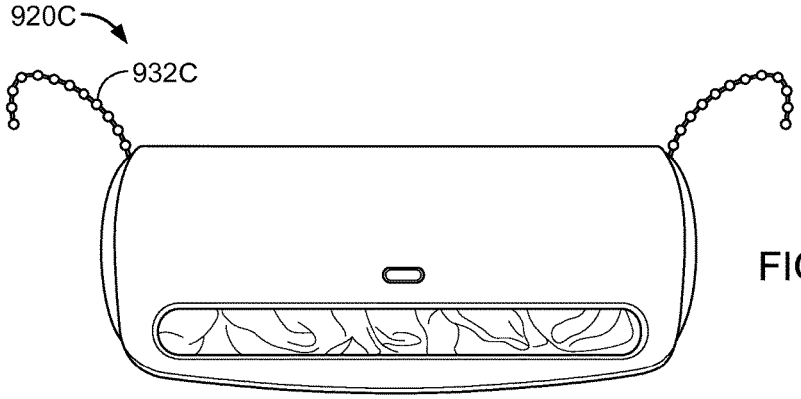

The reusable paper-towel holding apparatus 930C of FIG. 9C uses a rigid cable 932C which can be manipulated. The rigid cable 932C can be made of a chain of plastic pieces connected by connectors that allow the individual plastic pieces to move and rotate but still stay steady after manipulation. In one implementation, the rigid cable 932C is made up of Gorillapod™ flexible connector. In particular, the rigid cable 932C can be wrapped over or around an ear-muff style paper-towel holder (not shown). When released from user manipulation, the rigid cable 932C retains its shape. In this manner, the reusable paper-towel holding apparatus 930C can be hung or otherwise attached to an ear-muff style paper-towel holder.

Figure 9D:
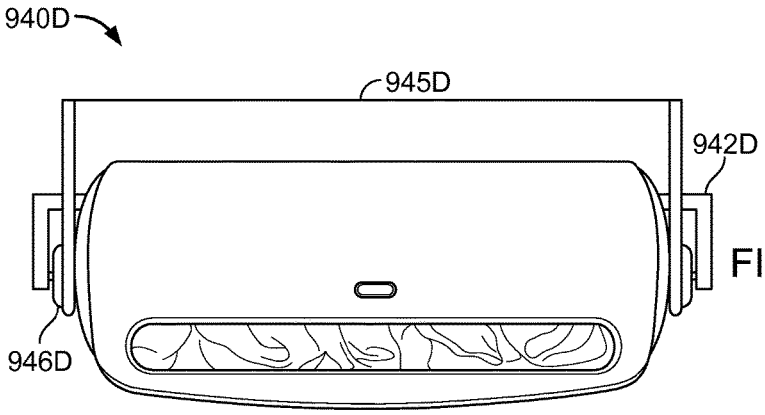

The reusable paper-towel holding apparatus 940D of FIG. 9D includes a wrap-around grip 942D. The grip 942D has a rigid shape that can be pulled open slightly to allow the ends of the grip to be slipped over the ends 946D of an ear-muff style paper-towel holder 945D. When released, the grip 942D squeezes the ends 946D of the ear-muff style paper-towel holder 945D, thereby creating a pressure. From this pressure, the reusable paper-towel holding apparatus is mounted on the ear-muff style paper-towel holder 945D. The grip 942D can be made from a material which provides some inherent flexibility while maintaining a permanent shape, such as, for example, plastic or rubber. In some implementations, rather than be flexible, the grip 942D includes a mechanism to shrink its length. For example, after placing the grip 942D around the ends 946D, a cap can be operated to shrink the length of the grip 942D. By shrinking the length of the grip 942D, the grip 942D can be made to apply pressure to the ends 946D.

In various implementations, the reusable paper-towel holding apparatus can use flexible end-caps along with, or in lieu of, the features described with respect to FIGS. 9A-9D to enable mounting on an ear-muff style paper-towel holder. In particular, the opposing ends of the cylindrical body of a reusable paper-towel holding apparatus (such as, for example end caps 322A of FIG. 3A) can be made of a flexible material that is able to temporarily compress when under a compressing force, such as rubber or a flexible plastic. In order to mount such implementations, the end caps of the reusable paper-towel holding apparatus are pressed inward before placing the apparatus between the ear-muffs. Thereafter, the end-caps resume their shape against the ear-muffs. In this manner, a reusable paper-towel holding apparatus is able to be mounted on rigid ear-muffs. Also, in some implementations, the end-caps employ a metal spring.

Depending upon the circumstance, a reusable paper-towel may be used multiple times before being cleaned. For instance, while a reusable paper-towel used to wipe food parts may not remain sanitary after a single use, a reusable paper-towel used to dry a washed dish may remain sanitary after multiple uses. For various reasons, however it may not be practical for the user to simply reinsert a used but sanitary reusable paper-towel into a reusable paper-towel holding apparatus.

As discussed above, many implementations of reusable paper-towel holding apparatus are configured to maintain non-structured paper-towels which can be removed through an opening which is configured to allow ease of removal but not ease of insertion. As such, to easily reinsert a used reusable paper-towel, a user may be required to open a separate loading mechanism and/or dismount the reusable paper-towel holding apparatus. Such a requirement may not facilitate using a reusable paper-towel multiple times before washing.

Moreover, after a use, a reusable paper-towel may be wet. Reinserting a wet reusable paper-towel into an enclosed compartment may facilitate the growth of mold or otherwise lead to non-sanitary conditions. Therefore, a user may wish to dry the towel before placing the towel in the reusable paper-towel holding apparatus of reusing.

Figure 10A:
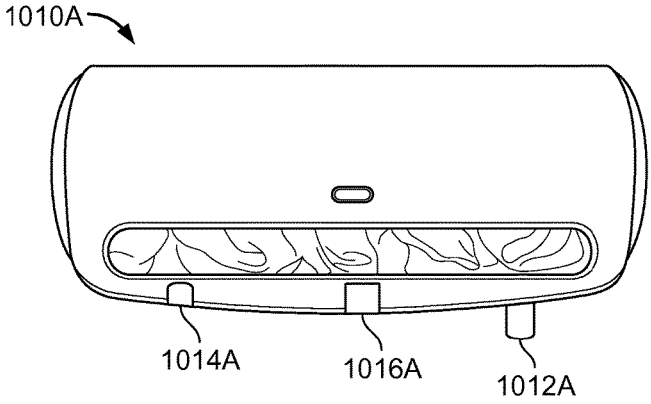
FIGS. 10A & 10B are example illustrations of reusable paper-towel holding apparatuses with reusable paper-towel hanging structures.
Figure 10B:
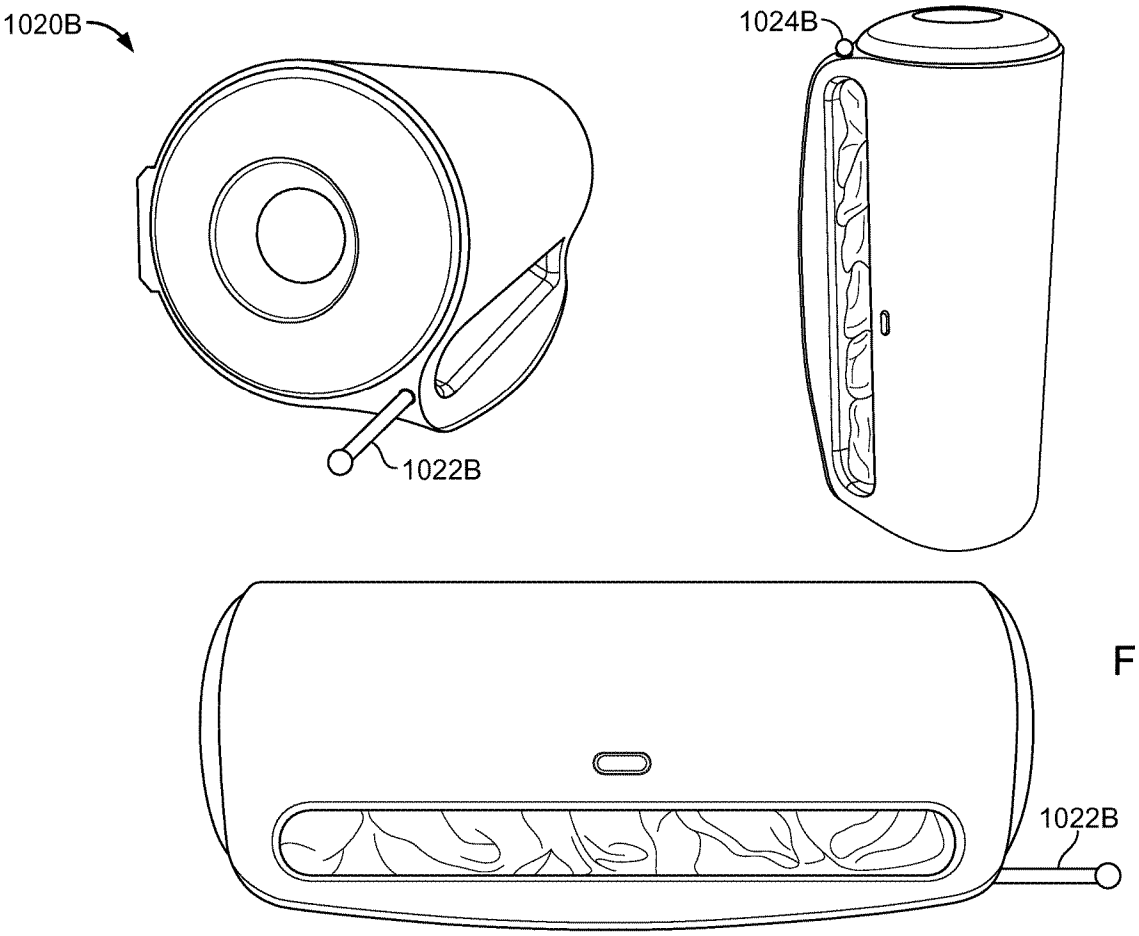

Accordingly, in order to enable a user to use a reusable paper-towel multiple times before cleaning, external reusable paper-towel holding structures may be used. FIGS. 10A & 10B are example illustrations of reusable paper-towel holding apparatuses 1010A & 1020B with external reusable paper-towel holding structures. The reusable paper-towel holding apparatus 1010A of FIG. 10A includes an external hook 1012A. The external hook 1012A can be used to hook a reusable paper-towel along the outside of the device to facilitate ease of reuse and drying. The external hook 1012A can be configured to be able to be placed in a retracted position 1014A inside the reusable paper-towel holding apparatus 1010A. When in the retracted position 1014A, an internal latch (not shown) locks the external hook 1012A in its retracted state. If the internal latch is released by a user action on a button 1016A, the external hook 1012A is forced downward to its external position by a spring loaded mechanism (not shown). In other implementations, the external hook 1012A of FIG. 10A can be replaced with a spring loaded clip.

The reusable paper-towel holding apparatus 1020B of FIG. 10B includes an external bar 1022B. The external bar 1022B can be used to drape a reusable paper-towel along the outside of the device to facilitate ease of reuse and drying. The external bar 1022B can be configured to be able to be placed in a retracted position 1024B inside the reusable paper-towel holding apparatus 1020B. In some implementations, the external bar 1022B is free to slide in and out of the device from the retracted position 1024B to an external position. In other implementations, an internal latch (not shown) can be used to lock the external bar 1022B in its retracted position 1024B. If the internal latch is released by a user action on a button 1026B (not shown), the external bar 1022B is forced outward to its external position by a spring loaded mechanism (not shown).

Figure 11A:
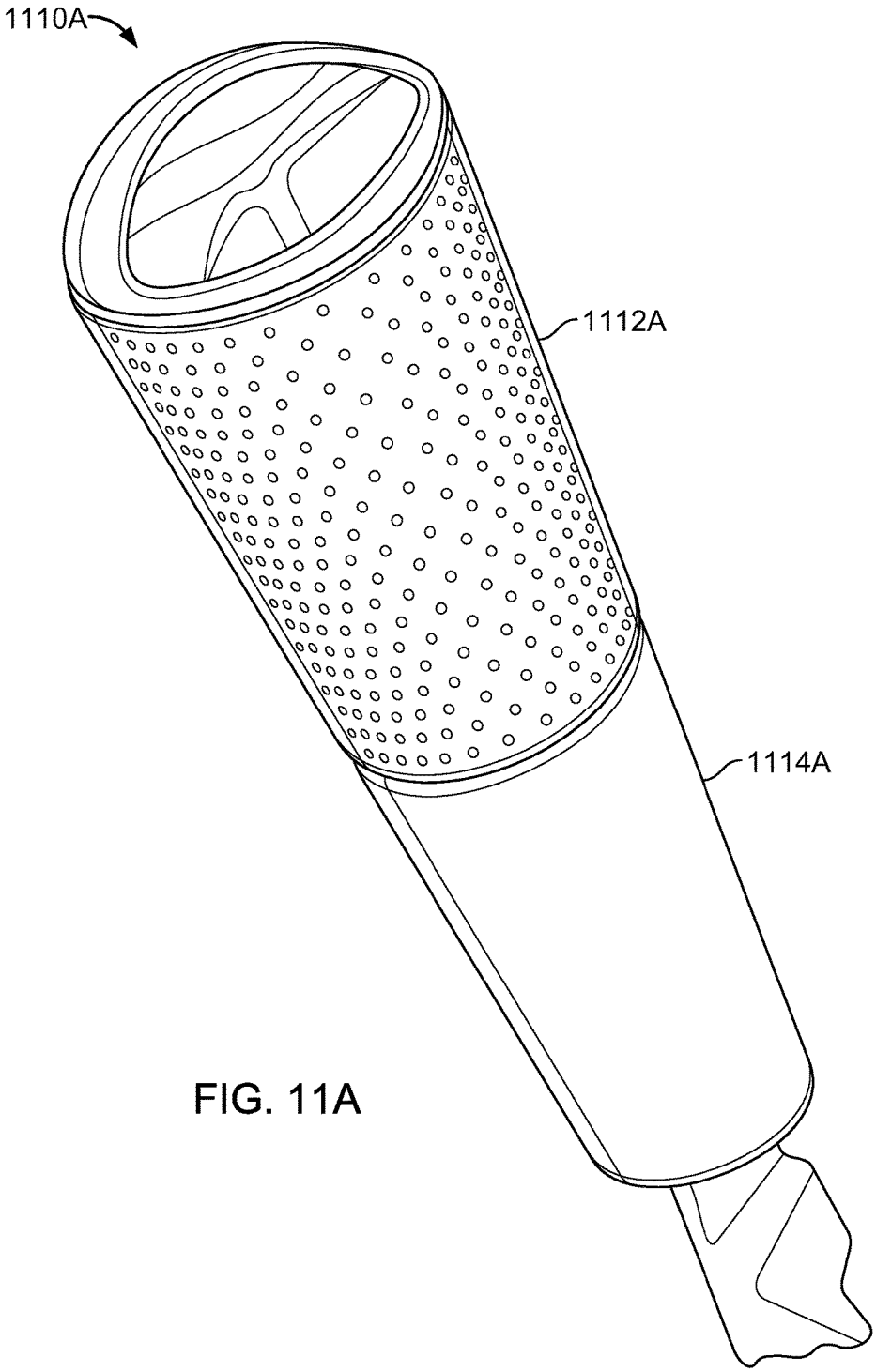
FIGS. 11A & 11B are example illustrations of reusable paper-towel holding apparatuses with dual internal compartments individually tailored for used and unused reusable paper-towels, respectively.
Figure 11B:
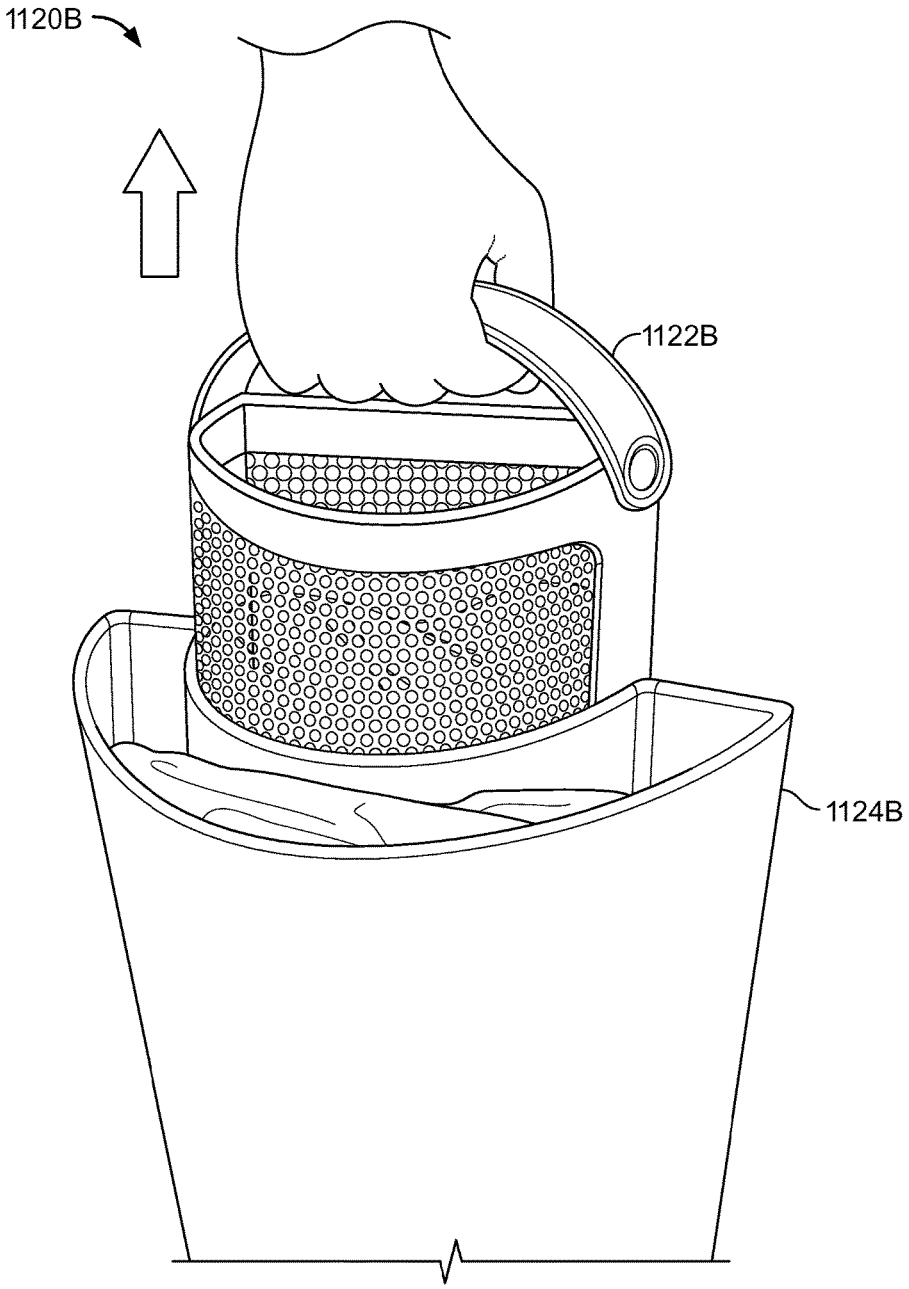

In some implementations, the reusable paper-towel holding apparatus is configured to hold both used (i.e., soiled) and unused (i.e., cleaned) reusable paper-towels internally. Such implementations can be convenient in that they can allow for reusable paper-towels to be kept together, both before and after they are used. Moreover, such implementations can be particularly useful for portable reusable paper-towel apparatus. FIGS. 11A & 11B are example illustrations of reusable paper-towel holding apparatuses 1110A and 1120B with dual internal compartments individually tailored for used and unused reusable paper-towels, respectively.

The reusable paper-towel holding apparatus 1110A of FIG. 11A includes a used compartment 1112A and a unused compartment 1114A. Each of the used and unused compartments 1112A and 1114A are adapted to promote sanitary condition with respect to the type of reusable paper-towel they hold. In particular, the used compartment 1112A includes a mesh covering. Because a used reusable paper-towel may be wet and susceptible to mold or bacterial growth, the mesh covering includes numerous holes allowing for the stored reusable paper-towels to dry. In this manner, the used compartment 1112A is adapted to promote sanitary condition of used reusable paper-towels. On the other hand, the unused compartment 1114A includes a continuous covering which does not include holes. The continuous covering shields unused reusable paper-towels from contamination originating outside reusable paper-towel holder. In this manner, the unused compartment 1114A is adapted to protect the existing sanitation of cleaned reusable paper-towels.

The reusable paper-towel apparatus 1120B of FIG. 11B includes a further feature with respect to the used compartment 1122B and unused compartment 1124B. In particular, the used compartment 1122B of the reusable paper-towel apparatus 1120B is able to be removed from its attachment to the used compartment 1124B. Removal of the used compartment 1122B can provide convenience for cleaning of the used reusable paper-towels. Moreover, in some implementations, the used compartment 1122B can be closed (not shown). In these implementations, the used compartment can be washed (such as in a conventional washing machine) with the used reusable paper-towels stored inside. In this manner, the used reusable paper-towels can be cleaned without being removed from the used compartment 1122B.

A number of embodiments have been described. Nevertheless, it will be understood that various modifications may be made without departing from the spirit and scope of this disclosure. Accordingly, other embodiments are within the scope of the following claims.

What is claimed is:

1. A reusable towel dispenser comprising:

a reusable towel holding compartment including multiple reusable towels stored in a non-structured manner;

one or more reusable towel outputs of the reusable towel holding compartment, the reusable towel outputs being configured to:

enable a reusable towel of a group of non-structured reusable towels to be accessed and pulled, from the reusable towel holding compartment, out of the reusable towel dispenser, and prevent the group of non-structured reusable towels from falling out of the reusable towel holding compartment while the reusable towel dispenser rotates in a mounted position;

a reusable towel input of the reusable towel holding compartment, the reusable towel input being configured to allow a group of non-structured reusable towels to be concurrently loaded in the reusable towel holding compartment; and an outer circumferential casing of the reusable towel dispenser, wherein:

the reusable towel outputs are dispersed evenly around the outer circumferential casing, the reusable towel holding compartment is defined within the outer circumferential casing.

2. The reusable towel dispenser of claim 1 wherein the reusable towel input is an opening created by removal of a cap of the reusable towel dispenser.

3. The reusable towel dispenser of claim 1 wherein the reusable towel output is configured to be angled such that an opening of the reusable towel output is open upward when the reusable towel dispenser is mounted for use.

4. The reusable towel dispenser of claim 1 wherein the reusable towel output is configured to be angled such that an opening of the reusable towel output is open downward when the reusable towel dispenser is mounted for use.

5. The reusable towel dispenser of claim 1 wherein the reusable towel dispenser is configured to be mounted on a rod which is configured to mount a paper-towel roll.

6. The reusable towel dispenser of claim 1 wherein the reusable towel dispenser is configured to be mounted with an ear-muff holder which is configured to mount a paper-towel roll.

7. The reusable towel dispenser of claim 1 wherein the multiple reusable towels are cotton towels.

8. The reusable towel dispenser of claim 1 wherein the reusable towel dispenser is shaped substantially as a cylinder.

9. A method comprising:

loading, in a non-structured manner, a reusable towel dispenser with multiple reusable towels, the reusable towel dispenser comprising:

one or more similarly sized and shaped reusable towel outputs of the reusable towel holding compartment, the reusable towel outputs being configured to:

enable a reusable towel of a group of non-structured reusable towels to be accessed and pulled, from the reusable towel holding compartment, out of the reusable towel dispenser, and prevent the group of non-structured reusable towels from falling out of the reusable towel holding compartment while the reusable towel dispenser rotates in a mounted position, a reusable towel output of the reusable towel holding compartment, a reusable towel input of the reusable towel holding compartment, the reusable towel input being configured to allow the group of non-structured reusable towels to be loaded in the reusable towel holding compartment, and an outer circumferential casing of the reusable towel dispenser, wherein:

the reusable towel holding compartment is defined within the outer circumferential casing; and removing a reusable towel of the multiple reusable towels from the reusable towel holding compartment by pulling the reusable towel out of the reusable towel dispenser.

* * * * *